US006608641B1

(12) United States Patent
Alexandrovich et al.

(10) Patent No.: US 6,608,641 B1
(45) Date of Patent: Aug. 19, 2003

(54) ELECTROPHOTOGRAPHIC APPARATUS AND METHOD FOR USING TEXTURED RECEIVERS

(75) Inventors: Peter Steven Alexandrovich, Rochester, NY (US); Richard George Allen, Rochester, NY (US); Muhammed Aslam, Rochester, NY (US); Jiann-Hsing Chen, Fairport, NY (US); Diane M. Herrick, Rochester, NY (US); Robert Arthur Lancaster, Hilton, NY (US); Yee Seung Ng, Fairport, NY (US); Joseph A. Pavlisko, Pittsford, NY (US); Hwai-Tzuu Tai, Rochester, NY (US); Thomas Nathaniel Tombs, Brockport, NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 10/184,351

(22) Filed: Jun. 27, 2002

(51) Int. Cl.[7] ..... G03G 15/00

(52) U.S. Cl. ..... 347/131; 399/45; 399/302; 430/42

(58) Field of Search ..... 347/115, 118, 347/129, 131, 153, 156; 399/45, 67, 302; 430/42, 45, 47

(56) References Cited

U.S. PATENT DOCUMENTS 5,084,735 A * 1/1992 Rimai et al. ..... 399/302
5,110,702 A * 5/1992 Ng et al. ..... 430/99
5,370,961 A * 12/1994 Zaretsky et al. ..... 430/126
5,464,698 A * 11/1995 Chen et al. ..... 428/421
5,581,343 A * 12/1996 Chowdry et al. ..... 399/45
5,689,757 A * 11/1997 Ferrante et al. ..... 399/45
5,689,761 A * 11/1997 Denton et al. ..... 399/45
5,905,925 A * 5/1999 Kawabata et al. ..... 399/45
5,915,144 A * 6/1999 Ide et al. ..... 399/45
5,925,446 A * 7/1999 Matsuda et al. ..... 428/219
5,935,689 A * 8/1999 Foley et al. ..... 428/195
5,999,201 A * 12/1999 Dalal et al. ..... 347/115
6,088,565 A * 7/2000 Jia et al. ..... 399/302
6,184,911 B1 * 2/2001 Tombs ..... 347/117
6,224,978 B1 * 5/2001 Chen et al. ..... 428/376

FOREIGN PATENT DOCUMENTS

JP 4-253072 A * 9/1992
JP 4-316078 A * 11/1992
JP 4-358189 A * 12/1992
JP 11-271037 A * 10/1999

* cited by examiner

*Primary Examiner*—Joan Pendegrass
(74) *Attorney, Agent, or Firm*—Lawrence P. Kessler

(57) ABSTRACT

A printer for printing color toner images on a receiver member of any of a variety of textures. The printer has a number of tandemly arranged electrophotographic image-forming modules respectively including a plurality of imaging subsystems to form a colored toner image transferred to a receiver member, the transfer of toner images from each of the modules forming a color print of the receiver member which is fused to form a desired color print. The image quality of the color print is produced by control of nonoperational co-optimization of fusing parameters and imaging subsystem parameters enabling printing on the variety of textures of receiver member.

22 Claims, 6 Drawing Sheets

ELECTROPHOTOGRAPHIC APPARATUS AND METHOD FOR USING TEXTURED RECEIVERS

FIELD OF THE INVENTION

The invention relates to electrostatography and more particularly to an electrophotographic printing apparatus and method for using receiver members having a variety of surfaces including smooth, textured, and rough surfaces.

BACKGROUND OF THE INVENTION

An exemplary modular color printer, such as an electrographic or ink jet copier or printer, includes a number of tandemly arranged imaging-forming modules (see for example, Tombs, U.S. Pat. No. 6,184,911). Such a printer includes two or more single-color image forming stations or modules arranged in tandem and an insulating transport web for moving receiver members such as paper sheets through the image forming stations, wherein a single-color toner image is transferred from an image carrier, i.e., a photoconductor (PC) or an intermediate transfer member (ITM), to a receiver held electrostatically or mechanically to the transport web, and the single-color toner images from each of the two or more single-color image forming stations are successively laid down one upon the other to produce a plural or multicolor toner image on the receiver.

As is well known, a toner image may be formed on a PC by the sequential steps of uniformly charging the PC surface in a charging station using a corona charger, exposing the charged PC to a pattern of light in an exposure station to form a latent electrostatic image, and toning the latent electrostatic image in a development station to form a toner image on the PC surface. The toner image may then be transferred in a transfer station directly to a receiver, e.g., a paper sheet, or it may first be transferred to an ITM and subsequently transferred to the receiver. The toned receiver is then moved to a fusing station where the toner image is fused to the receiver by heat and/or pressure.

In a digital electrophotographic copier or printer, a uniformly charged PC surface may be exposed pixel by pixel using an electro-optical exposure device comprising light emitting diodes, such as for example described by Y. S. Ng et al., Imaging Science and Technology, 47th Annual Conference Proceedings (1994), pp. 622–625.

A widely practiced method of improving toner transfer is by use of so-called surface treated toners. As is well known, surface treated toner particles have adhered to their surfaces sub-micron particles, e.g., of silica, alumina, titania, and the like (so-called surface additives or surface additive particles). Surface treated toners generally have weaker adhesion to a smooth surface than untreated toners, and therefore surface treated toners can be electrostatically transferred more efficiently from a PC or an ITM to another member.

As disclosed in the Rimai et al. patent (U.S. Pat. No. 5,084,735) and in the Zaretsky and Gomes patent (U.S. Pat. No. 5,370,961), use of a compliant ITM roller coated by a thick compliant layer and a relatively thin hard overcoat improves the quality of electrostatic toner transfer from an imaging member to a receiver, as compared to a non-compliant intermediate roller.

A receiver carrying an unfused toner image may be fused in a fusing station in which a receiver carrying a toner image is passed through a nip formed by a heated compliant fuser roller in pressure contact with a hard pressure roller. Compliant fuser rollers are well known in the art. For example, the Chen et al. patent (U.S. Pat. No. 5,464,698) discloses a toner fuser member having a silicone rubber cushion layer disposed on a metallic core member, and overlying the cushion layer, a layer of a cured fluorocarbon polymer in which is dispersed a particulate filler. Also, in the Chen et al. patent application (U.S. Patent application Ser. No. 08/879,896) is disclosed an improved compliant fuser roller including three concentric layers, each of which layers includes a particulate filler.

An electrophotographic process for non-electrostatic transfer of a toned image from a photoconductive imaging member using an intermediate transfer roller with applied heat and pressure is disclosed in the Y. S. Ng et al. patent (U.S. Pat. No. 5,110,702). This process may be used for producing high-quality toner images on rough paper (paper roughness not defined in the Ng et al. patent), and full color images may be made by successive registered transfers of color separation toner images to form a composite toner color image on a receiver. The process suffers from a disadvantage in that prolonged exposure to heat by contact with the intermediate transfer roller can have a deleterious effect upon the life of the photoconductive imaging member.

According to the Dalal et al. patent (U.S. Pat. No. 5,999,201), an electrostatographic imaging method suitable for making high quality toner images on a rough recording sheet such as a rough paper employs electrostatic transfer of a sub-monolayer toner image from an imaging member to a compliant intermediate transfer member, followed by heating the toner image at a filming station, and subsequently transfusing the filmed toner image from the intermediate transfer member to a recording sheet (paper roughness not characterized quantitatively). Color images may be made by forming a composite film on the ITM from successive registered transfers of color separation toner images to the ITM, using the filming station after each transfer, with the composite film being subsequently transfused to a receiver. This method of making a full color image is more cumbersome than conventional methods employing intermediate transfer, i.e., in which a filming station is not used.

In common parlance or usage, paper roughness is an ill-defined quantity and has a subjective meaning related to the context. Thus, in ordinary speech one can speak of a "rough uncoated paper" in comparison to a "rough coated paper", with the latter being generally perceived as being quite smooth. Similarly, a "smooth uncoated paper" might be described or perceived as quite rough. For objective comparisons of roughness or smoothness, it is necessary to have resort to various techniques which have been developed for measuring surface contour parameters, e.g., of papers.

A printing medium having predetermined physical characteristics suitable for color xerographic printing, including paper smoothness, is disclosed in the Foley et al. patent (U.S. Pat. No. 5,935,689). This patent relates to usage of a base paper having a smoothness of less than or equal to about 110 Hagerty units. In common parlance or usage, a smoothness of less than about 120 Hagerty units would generally represent a quite smooth paper. Certain papers, according to U.S. Pat. No. 5,935,689, are not intended for electrophotographical printing. These excluded classes are known in the art as "Kraft", "Tissue", "Multiboard", "Corrugated Medium" and "Roofing" papers. Smoothness of paper or other receiver can be related to a surface roughness parameter and may be measured by a variety of techniques, including the Sheffield method, the Bekk method, surface photomicrography, the Gardner gravure method, the Brush surface analyzer, and the Chapman method, all of which are briefly described in, for example, Mead Paper Knowledge (Mead Corporation, Chillicothe, Ohio, first edition, 1990, pp. 164–166). See also TAPPI Test Methods, 1994–1995, published by TAPPI Press, Atlanta, Ga. The Sheffield method in particular is widely used, and is described in TAPPI publication T 538 om-88. Commercial instruments are available, such as Model 538 Paper Smoothness Tester from Hagerty Technologies, Inc., of Queensbury, N.Y., as well as the Sheffield Paper Gage, available from Testing machines Inc., of Amityville, N.Y. The Sheffield surface roughness parameter and unit of roughness is described in, for example, G. A. Hagerty et al., TAPPI Journal, January 1998, pp. 101–106. According to U.S. Pat. No. 5,935,689, Sheffield units and Hagerty units are interchangeable terms. Sheffield units are usually referred to in the literature and are used henceforth herein.

The Kawabata et al. patent (U.S. Pat. No. 5,905,925) discloses apparatus for forming electrophotographically produced toner images on unconventional receivers, including multilayer receivers, tack film, cloth paper, and cloth, e.g., tee shirts. Process set points, e.g., for charging, transferring, fusing, are adjusted for known receiver physical characteristics, such as for example, electrical resistivity and thickness.

The Matsuda et al. patent (U.S. Pat. No. 5,925,446) teaches the use of a coated base material as a receiver, where the uncoated base material includes mechanical paper, rough paper, or recycled paper, and the receiver may further comprise a filler. The coating on the receiver is smoothed, e.g., by calendaring, prior to use of the receiver for electrophotography. According to this patent, Oken's smoothness as measured by a method described in Japan TAPPI No. 5 must be greater than 40 sec., otherwise good transfer of a toner image to the receiver cannot be made.

A transfuse system disclosed by the Jia et al. patent (U.S. Pat. No. 6,088,565) includes transfer in a first transfer nip of a toner image to an intermediate transfer member, transfer in a second transfer nip from intermediate transfer member to a transfuse member, and combined transfer and fusing of the toner image in a third transfer nip from transfuse member to a receiver. The transfuse member is highly conformable for aiding transfer to rough substrates in the third transfer nip.

Images on textured paper are in demand by a significant segment of customers in the printing marketplace. While traditional non-electrostatographic color printing methods, e.g., offset printing, are able to produce high quality prints on textured paper, there remains a need in the electrostatographic printing industry for improved apparatus for making good quality prints, especially color prints, on a receiver having a textured or a rough surface. In particular, there is a need for improved non-thermal electrostatic transfer apparatus for transferring toner images to textured papers, because non-thermal transfer is inherently simpler for this purpose than thermally assisted transfer, e.g., as described in the above-cited U.S. Pat. Nos. 5,110,702; 5,999,201; and 6,088,565. Moreover, there remains a need to provide a printer that is capable of making good quality color prints on different types of receivers, e.g., on papers having a variety of surface roughnesses ranging from very smooth to visibly patterned.

The present invention, which provides improved electrophotographic color printing apparatus and method utilizing electrostatic transfer of toner, is for making color images on various types of receivers having different surface roughnesses or surface contouring characteristics, which various types of receivers include papers having smooth, rough, textured, patterned, or woven surfaces, as well as fabrics or fabric-reinforced sheet materials.

SUMMARY OF THE INVENTION

A modular color printer is disclosed for producing good quality images on receiver members having a variety of types of surface, which types of surface are generally characterizable by measurable surface contour parameters. Receiver members may have smooth, rough, textured, patterned, or woven surfaces, and include papers, fabrics, and fabric-reinforced sheets. The printer includes a number of tandemly arranged image-forming modules, with each module including a plurality of imaging subsystems for producing a single-color toner image. Receiver members are moved successively through the image-forming modules and from thence through a fusing station included in the printer. A single-color toner image is transferred to a receiver member in each successive module such that a full color toner image is built up on the receiver member as the receiver member moves from the first to the last module. In one aspect of the invention, at least a predetermined nominal image quality is generally achieved by a co-optimization of fusing station performance with the imaging performances of all the image-forming modules, which nominal image quality can be produced for full-color toner images made on receiver surfaces having widely differing smoothnesses. Thus, in a given module, optimized subsystems may include a pre-optimized exposure subsystem using light emitting diodes, a pre-optimized development subsystem using surface treated toners, and a pre-optimized electrostatic transfer subsystem using a compliant intermediate transfer roller. Similarly, a pre-optimized fusing subsystem preferably includes a compliant fuser roller for use in conjunction with the optimized subsystems of the modules. In another aspect of the invention, co-optimization can be augmented by adjustments of individual imaging subsystems included in each of the image-forming modules and by adjustments of the fusing subsystem, which adjustments can depend on pre-known characteristics of a particular type of receiver member surface.

Thus, in one embodiment for printing on various types of receiver members included in a predetermined set of types of receiver members, operational parameters of the pre-optimized imaging or fusing subsystems are not adjusted when receiver members included in the predetermined set of receiver members pass successively through the printer, i.e., are not operationally adjusted for the differing surface contour parameters of these receiver members. In other embodiments, pre-optimized material and operational parameters relating to the subsystems are used as base-line parameters for operation of the printer, with certain of these base-line parameters relating to individual subsystems being operationally adjustable from their base-line values so as to fine tune the resulting image quality on any particular type of suitable receiver member included in the predetermined set of types of receiver members.

Key attributes of the invention include improved ability to efficiently transfer toner images to a hill-and-valley type of surface topography on a receiver member, and also to successfully fuse toner particles, especially those toner particles in valleys, to the receiver member.

The invention, and its objects and advantages, will become more apparent in the detailed description of the preferred embodiment presented below.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, relative proportions depicted or indicated of the various elements of which disclosed members are comprised may not be representative of the actual proportions, and some of the dimensions may be selectively exaggerated.

FIG. 2(*b*) shows a side elevational view of a preferred fuser roller for use in the fusing station of FIG. 1;

FIG. 2(*c*) shows a side elevational view of a preferred pressure roller for use in the fusing station of FIG. 1;

FIG. 5(*b*) is a graph of measured mottle number versus Sheffield Number for different receiver members; and FIG. 5(*c*) is a graph of measured mottle number versus MPE for different receiver members.

DETAILED DESCRIPTION OF THE PREFERRED EMBODIMENTS

Figure 1:
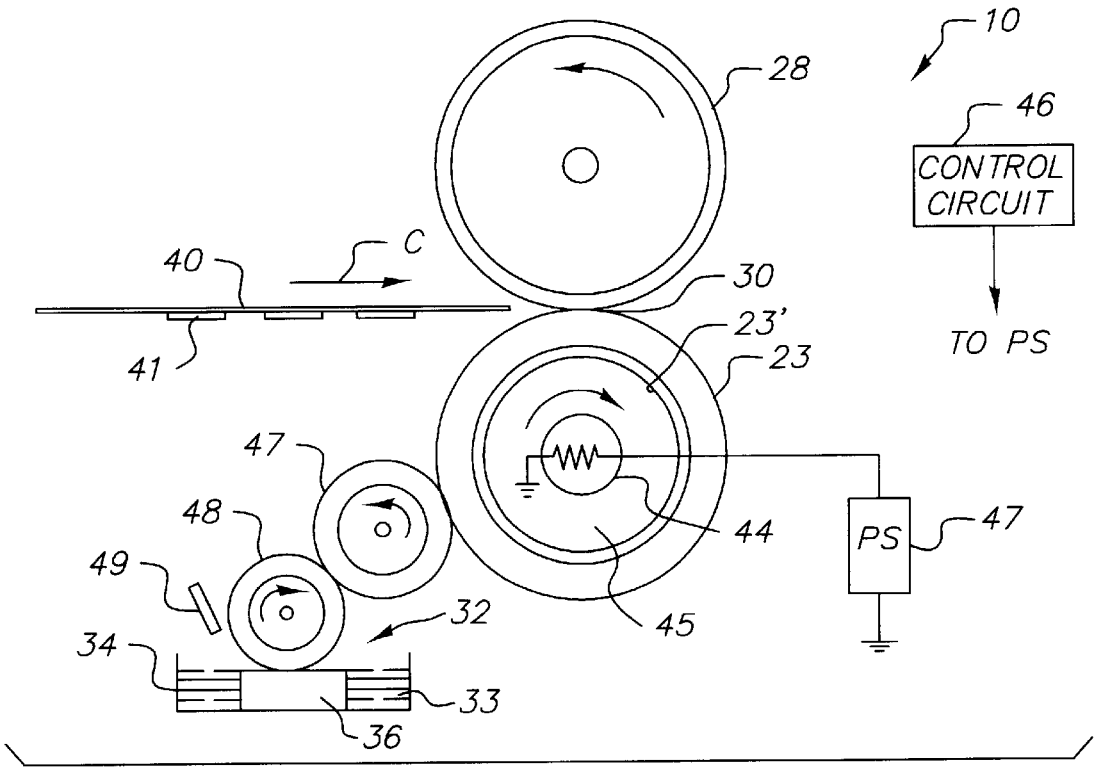
FIG. 1 shows a side elevational view of a preferred fusing station of an apparatus of the invention.

Because apparatus of the type described herein are well known, the present description will be directed in particular to subject matter forming part of, or cooperating more directly with, the present invention.

The invention is a printer preferably used for full color printing or recording utilizing plural color toner images, whereby each color toner image is formed on a primary image-forming member (PIFM), transferred in a primary transfer step to an intermediate transfer member (ITM), and subsequently transferred in a secondary transfer step to a transferee surface of a receiver member, which receiver member may be, e.g., a smooth paper or plastic, a textured or a rough paper, a paper including woven material, or a fabric or a cloth. A transferee surface is the surface of a receiver member to which one or more toner images are transferred to form an output print thereon.

In a printer of the invention, color separation images are formed in successive tandemly arranged color modules and transferred in register to a receiver member, the receiver member being moved through the apparatus while supported on a receiver transport web. In each module a toner image is electrostatically transferred, without thermal assist, from a respective moving primary image-forming member, e.g., a photoconductor, to a moving intermediate transfer member, which toner image, e.g., a single-color toner image, is then electrostatically transferred without thermal assist from the intermediate transfer member to a transferee surface of a moving receiver member. The receiver member is in sheet form and can include one or more of a group of materials including paper, polymeric materials including rubbers and plastics, coatings including clay coatings and polymer coatings, fibers including polymer fibers and textile fibers, reinforcing materials, fabrics, and cloth. The receiver member is moved progressively through the imaging-forming modules, wherein in each successive module the respective toner image is transferred from the respective primary image-forming member to a respective intermediate transfer member and from thence to the moving receiver member, the respective single-color toner images being successively laid down one upon the other on the receiver member so as to complete, in the last of the modules, a multicolor toner image, e.g., a four-color toner image, which receiver member is then moved to a fusing station or fusing subsystem wherein the full-color toner image is fused to the receiver member. Typically, colored toners for use in the above-described apparatus are included in a 4-color set tailored for color imaging. Such a 4-color set usually includes black, cyan, magenta and yellow toners, although other color sets may instead be used. Furthermore, as is known, certain ones of the number of modules (which may exceed four) may employ other types of toners, such as for example specialty color toners or clear toners.

Each module of the printer includes a plurality of electrophotographic imaging subsystems for producing a single-color toner image. Included in each imaging subsystem is a charging subsystem for charging a photoconductive imaging member, an exposure subsystem for imagewise exposing the photoconductive imaging member, a development subsystem for toning the imagewise exposed photoconductive imaging member, and an intermediate transfer subsystem for transferring toner images from the photoconductive imaging member to an intermediate transfer member, and from the intermediate transfer member to receiver members. The imaging subsystems and the fusing subsystem are characterized by imaging subsystem parameters and fusing subsystem parameters, which parameters include material properties and characteristics of the various elements included in the subsystems, as well as dimensions of these elements. The imaging subsystem parameters and fusing subsystem parameters also include operational setpoints as well as operating conditions such as for example temperatures, concentrations, pressures, voltages, and so forth.

As an alternative to electrophotographic imaging in each module, there may be used electrographic recording of each primary color image using stylus recorders or other known recording methods for recording on a dielectric primary image-forming member a toner image that is to be transferred electrostatically to an ITM as described herein or any other-suitable recording method.

Figure 3:
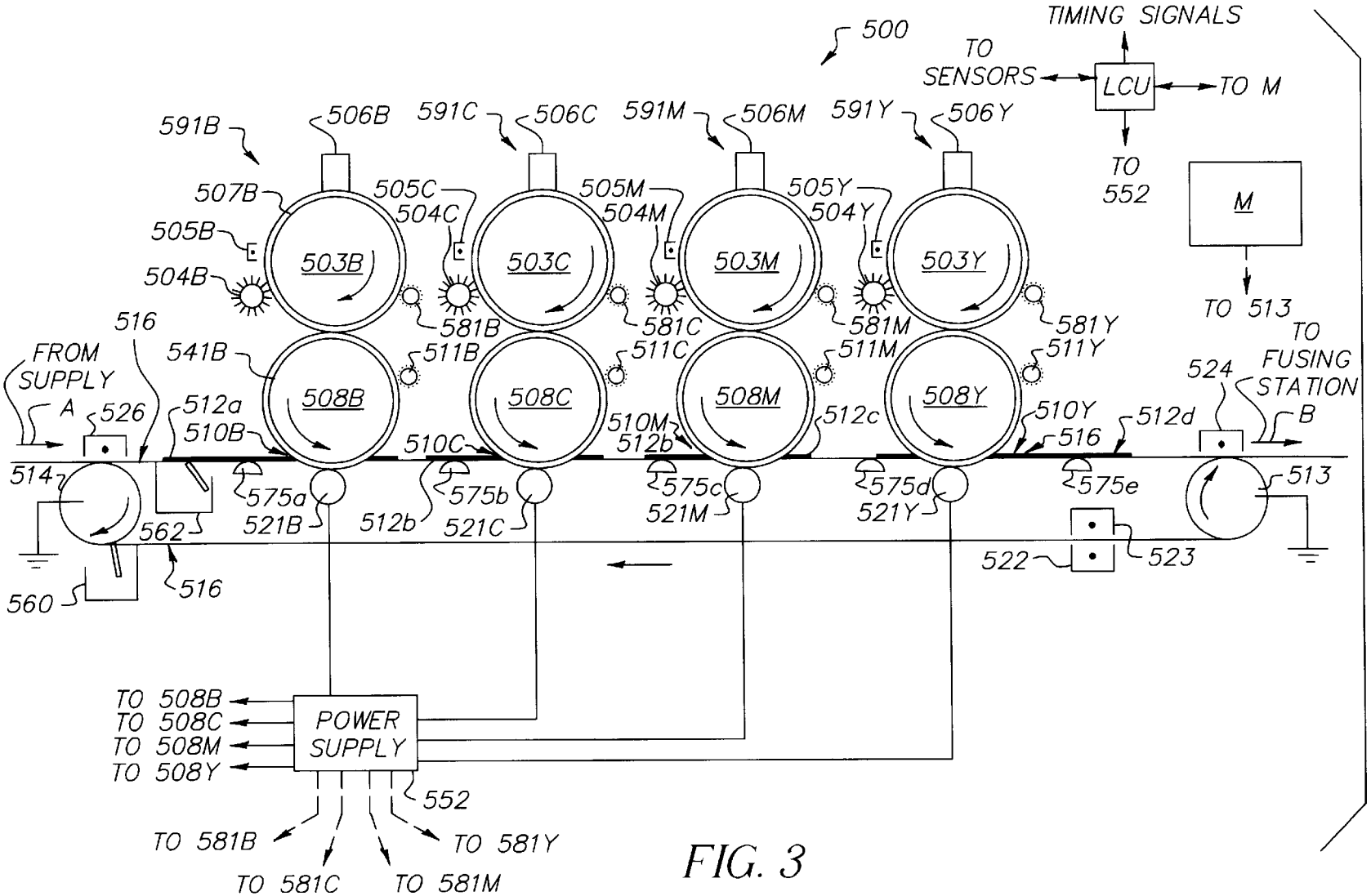
FIG. 3 is a generally schematic side elevational view of an imaging apparatus, for use in a printer of the invention, which imaging apparatus utilizes four modules, each module including a photoconductive primary image-forming member from which a corresponding single-color toner image is electrostatically transferred to an intermediate transfer roller, with an endless web and web-driving mechanism for facilitating non-thermally-assisted electrostatic transfer of the corresponding single-color toner image from the intermediate transfer roller to a receiver member adhered to and carried by the endless web through each of the four modules and thence through a fusing station included in the printer, only basic components being shown for clarity of illustration.

Referring now to the figures, FIG. 3 shows a side elevational view of an exemplary modular apparatus, for use in a color printer of the invention, indicated by the numeral 500. Modular apparatus 500 includes a number of tandemly arranged electrostatographic imaging-forming modules (see for example U.S. Pat. No. 6,184,911). The apparatus 500 features four color modules, although this invention is applicable to one or more such modules.

The four exemplary color modules of apparatus 500 are for preferably forming black, cyan, magenta, and yellow color toner separation images. Elements in FIG. 3 that are similar from module to module have similar reference numerals with a suffix of B, C, M and Y referring to the color module to which it is respectively associated. Each module (591B, 591C, 591M, 591Y) is of similar construction except that as shown one receiver transport web (RTW) 516 in the form of an endless belt operates with all the modules and the receiver member is transported by the RTW 516 from module to module. Receiver members are supplied from a paper supply unit, thereafter preferably passing through a paper conditioning unit (not shown) before entering the first module in a direction as indicated by arrow A. The receiver members are adhered to RTW 516 during passage through the modules, either electrostatically or by mechanical devices such as grippers, as is well known. Preferably, receiver members are electrostatically adhered to RTW 516 by depositing electrostatic charges from a charging device, such as for example by using a tack-down corona charger 526. Three receiver members or sheets 512*a, b, c* are shown (simultaneously) receiving images from modules 591 B, C, M. A fourth receiver member, 512*d*, having received a multicolor color toner image thereon, is shown supported by the RTW 516 after having passed through module 591Y. It will be understood as noted above that each receiver member may receive one color image from each module and that in this example up to four color images can be received by each receiver member. The movement of the receiver member with the RTW 516 is such that each color image transferred to the receiver member at the transfer nip of each module is a transfer that is registered with the previous color transfer so that a four-color image formed on the receiver member has the colors in registered superposed relationship on the transferee surface of the receiver member. The receiver members are then serially detacked from RTW 516 and sent in a direction indicated by arrow B to a fusing station (not shown in FIG. 3, but see, for example, FIG. 1) to fuse or fix the dry toner images to the receiver member. The RTW is reconditioned for reuse by providing charge to both surfaces using, for example, opposed corona chargers 522, 523 which neutralize charge on the two surfaces of the RTW.

Each color module includes a primary image-forming member, for example a drum or primary image-forming roller (PIFR) labeled 503B, C, M, Y respectively. Each PIFR 503B, C, M, Y has a respective photoconductive surface structure 507B, C, M, Y having one or more layers, upon which a pigmented marking particle image, or a series of different color marking particle images, is formed (individual layers of PIFRs not shown). In order to form toned images, the outer surface of the PIFR is uniformly charged by a primary charger such as a corona charging device 505B, C, M, Y, respectively, or by other suitable charger such as a roller charger, a brush charger, etc. The uniformly charged surface is preferably exposed by a respective image writer or exposure device 506B, C, M Y, which exposure device is preferably an LED or other electro-optical exposure device. Alternative exposure devices may be used, such as for example an optical exposure device to selectively alter the charge on the surface of the PIFR. The exposure device creates an electrostatic image corresponding to an image to be reproduced or generated. The electrostatic image is developed, preferably using the well-known discharged area development technique, by application of pigmented marking particles to the latent image bearing photoconductive drum by a development station 581B, C, M, Y, respectively, which development station employs so-called "SPD" (Small Particle Development) method and apparatus (see E. Miskinis, IS&T's Sixth International Conference, *Advances in Non-Impact Printing Technologies*, pp. 101–110, 1990). Each of development stations 581B, C, M, Y is respectively biased by a suitable respective voltage in order to develop the respective latent image, which voltage may be supplied by a power supply, e.g., power supply 552, or by individual power supplies (not illustrated). A respective developer includes toner marking particles and magnetic carrier particles, which developer has a preferred toner concentration of approximately 6% wt/wt, although other toner concentrations may be used. A preferred value of charge-to-mass ratio of toner particles is approximately 35 microcoulombs per gram, although other values of charge-to-mass ratio may be used. Each development station has a particular color of pigmented toner marking particles associated respectively therewith for toning. Thus, each module creates a series of different color marking particle images on the respective photoconductive drum. In lieu of a photoconductive drum which is preferred, a photoconductive belt may be used.

It is well established that for high quality electrostatographic color imaging, small toner particles are necessary. In the present invention, small toner particles having a mean volume weighted diameter in a range of approximately between 2 $\mu$m–9 $\mu$m are preferably used, more preferably between 7 $\mu$m–9 $\mu$m, although particles having a mean volume weighted diameter larger than 9 $\mu$m can also be used satisfactorily (mean volume weighted diameter determined by a suitable commercial particle sizing device such as a Coulter Multisizer). A widely practiced method of improving toner transfer is to use toner particles having sub-micron particles of silica, alumina, titania, and the like, attached or adhered to the surfaces of toner particles (so-called surface additives). In practice of the present invention, it is preferred to use a surface additive made of sub-micron silica particles, but other sub-micron particle additives may also be useful, singly or in combination. Preferably, toner particles have a surface concentration of silica particles equivalent to a weight percent (of the total toner weight) in a range of approximately 0.5%–2.0% wt/wt, and more preferably, 1.0%–1.5% wt/wt, with the silica particles having a BET surface area in a range of approximately 50 $m^2$/gram–300 $m^2$/gram, and more preferably, 110 $m^2$/gram–200 $m^2$/gram.

In an embodiment of modular apparatus 500, operational parameters of the respective corona charging devices 505B, C, M, Y include pre-optimized aim values of charging voltage to which each of the primary image-forming members 503B, C, M, Y is respectively charged, which pre-optimized aim values of charging voltage are independent of the type of transferee surface of a receiver member passing through the modules. In alternative embodiments, the respective aim values of charging voltage may be operationally adjusted for different types of transferee surface, e.g., for receiver members having different surface topographies characterizable by different surface contour parameters.

In an embodiment of modular apparatus 500, operational parameters of the respective developers and toners used in stations 581B, C, M, Y are characterized by pre-optimized developer aim values, e.g., of toner concentrations in the respective developers, surface additive concentrations on the respective toners, and charge-to-mass ratios of the respective toners, which developer aim values are independent of the type of transferee surface of a receiver member passing through the modules. Similarly, in this embodiment, pre-optimized voltages are supplied to development stations 581B, C, M, Y by power supply 552. Note that certain special receiver members could have different surface regions having different types of surface contouring or roughness, e.g., embossing for a logo, etc, for which this embodiment is advantageous.

In alternative embodiments, different developer aim values for the developers may be used for different types of transferee surface, e.g., for receiver members having different surface topographies characterizable by different surface contour parameters. Similarly, development voltages supplied to the development stations may be adjusted for different types of transferee surfaces. In these alternative embodiments, the development characteristics of the developers may be altered as required, e.g., by operationally adjusting the toner concentrations or by altering the rate of mechanical motions associated with the development stations. Such adjusting may be done for all development stations similarly, or it may be done for individual development stations as required. Similarly, development voltages supplied to the development stations may be adjusted for all development stations similarly, or may be adjusted for individual development stations as required. Thus, it has been found that for transferee surfaces which are rough or are heavily textured, a larger coverage of toner than would otherwise be required is generally necessary for developing a latent image in order to produce a satisfactory print, i.e., after transfer of toner images to a receiver. This can be achieved by the above-described alterations of development voltage, toner concentration, or rate of mechanical motions associated with the development stations.

Each marking particle image formed on a respective PIFR is transferred to a compliant surface of a respective secondary or intermediate image transfer member, for example, an intermediate transfer roller (ITR) labeled 508B, C, M, Y, respectively. After transfer, the residual toner image is cleaned from the surface of the photoconductive drum by a suitable cleaning device 504B, C, M, Y, respectively, so as to prepare the surface for reuse for forming subsequent toner images.

The surface of ITR 508B is coated by a structure 541B, which structure includes one or more layers including a compliant blanket layer surrounding a substantially cylindrical core member (individual layers of structure 541B not separately indicated in FIG. 3—see FIG. 4 below). Structures similar to 541B are shown as included in ITR 508C, M, Y, respectively (but not labeled). The core member is precision made to high tolerance, the amount of runout preferably being less than 80 $\mu$m, and more preferably, less than 20 $\mu$m. The compliant blanket layer is preferably formed of a polymeric material, e.g., an elastomer such as polyurethane or other materials well noted in the published literature. An elastomeric blanket layer may be doped with sufficient conductive material (such as anti-static compounds known as anti-stats, ionic conducting materials, or electrically conducting dopants) to have a suitably low resistivity.

Generally speaking, the compliance of structure 541B may be considered in terms of macrocompliance and microcompliance. In macrocompliance, the structure is able to conform to form a nip. Microcompliance, on the other hand, comes into play at, for example, the scale of individual toner particles, edges of large toned solid areas, and paper surface contours.

Figure 4:
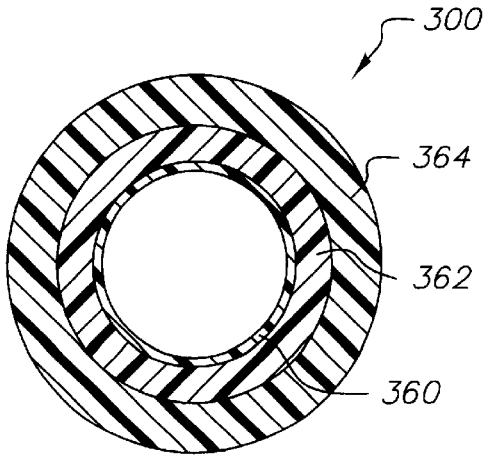
FIG. 4 shows a side elevational view of a preferred intermediate transfer roller for use in the printer of FIG. 3.

A preferred intermediate transfer roller, for use in modular apparatus 500, is shown in cross section in FIG. 4 and indicated by the numeral 300. Roller 300 includes a hollow precision made metal core 260, preferably of aluminum. A compliant structure, coated on the core 360 (and corresponding to structure 541B) includes two layers, i.e., an electrically resistive compliant layer 362 and a thin, hard outer release layer 364 overcoated on the compliant layer. The compliant layer 362 is made of an elastomer, preferably a polyurethane elastomer, the elastomer being doped with sufficient conductive material (such as antistatic particles, ionic conducting materials, or electrically conducting dopants) to have a relatively low bulk or volume electrical resistivity, which resistivity is preferably in a range of approximately $10^7$ to $10^{11}$ ohm-cm, and more preferably about $10^9$ ohm-cm. The preferred thickness of the compliant layer 362 is in a range of approximately 5–15 mm, and more preferably, is about 10 mm. The compliant layer 362 has a Young's modulus in a range of approximately 3.45–4.25 megapascals, and a Shore A hardness in a range of approximately 55–65.

The outer release layer 364 is preferably made of a ceramer, such as described in Ezenyilimba et al., U.S. Pat. No. 5,968,658. Layer 364 has a preferred thickness in a range of approximately 3–10 micrometers, and more preferably, 4–6 micrometers. The resistivity of the release layer 364 is preferably in a range of approximately $10^7$–$10^{13}$ ohm-cm. Any suitable outer release layer material may be used.

In an embodiment of modular apparatus 500, operational parameters for respective secondary transfers from intermediate transfer rollers 508B, C, M, Y to receivers having different types of transferee surfaces are characterized by pre-optimized intermediate transfer aim values. Pre-optimized intermediate transfer aim values include: pre-optimized voltage applied by power supply 552 to respective transfer backup rollers 521B, C, M, Y; pre-optimized lineal pressure in the respective transfer nips 51OB, C, M, Y; pre-optimized engagement in the respective transfer nips 510B, C, M, Y; and pre-optimized nip width in the respective transfer nips 510B, C, M, Y. The intermediate transfer aim values in this embodiment are independent of the type of transferee surface of a receiver passing through the modules. Note that certain special receivers could have different surface regions having different types of surface contouring or roughness, e.g., embossing for a logo, etc, for which this embodiment is advantageous. In alternative embodiments, different intermediate transfer aim values may be used for different types of transferee surfaces, e.g., for receivers having different surface topographies characterizable by different surface contour parameters. In these alternative embodiments, the transfer parameters in the respective transfer nips 510B, C, M, Y are respectively alterable as required, e.g., by selectively operationally adjusting the transfer voltage for the respective secondary transfer nip (e.g., by using the logic and control unit LCU), or by operationally adjusting the lineal pressure, the engagement, or the nip width for the respective secondary transfer nip by means of a suitable mechanism, which mechanism can be an air pressure-regulating mechanism for controlling nip pressure via an air hydraulic device. Such adjusting of nips may be done for all secondary transfer nips similarly, or it may be done for individual secondary transfer nips as required. Moreover, in these alternative embodiments, the engagement in the respective transfer nips 510B, C, M, Y may be adjusted in order to accommodate receiver members of differing thicknesses, or in particular, to accommodate differing types of receiver members having differing combinations of thickness and transferee surface topography. Thus the engagement may be adjusted by sending a signal, e.g., from a computer so as to activate a mechanism for changing the engagement in the respective transfer nips 510B, C, M, Y. Such a mechanism (not shown in FIG. 3) is disclosed in the May et al. patent (U.S. Pat. No. 5,966,559). Such changing of engagement may be done for all secondary transfer nips similarly, or it may be done for individual secondary transfer nips as required.

Referring again to FIG. 3, an electrical bias is applied by a power supply 552 to an ITR 508B, C, M; Y, respectively in order to effect non-thermally assisted electrostatic primary transfer of a toner image from a PIFR 503B, C, M, Y, respectively. A logic and control unit (LCU) controls the respective electrical biases to TR 508B, C, M, Y, respectively.

By using an ITM according to the invention, i.e., having a relatively conductive structure, efficient primary transfer of a single color marking particle image from a PWFR to the surface of an ITM can be accomplished with a relatively narrow nip width (preferably 2–15 mm and more preferably 3–8 mm).

A single color marking particle image, after primary transfer from PWFR 503B to the surface of structure 541B of roller 508B, is transferred to the transferee surface of a receiver member, which receiver member is fed into a nip 510B between the intermediate image transfer member drum and a transfer backing roller (TBR) 521B, with the TBR suitably electrically biased by power supply 552 to induce the charged toner particle image to transfer to the receiver member sheet. Similarly, after primary transfer of single-color toner images on to intermediate image transfer member drums 508C, M, Y, respectively, the receiver member moves serially into each of the other nips 510C, M, Y where it receives in secondary transfers the respective marking particle images in suitable registered relationship to form a composite plural color image, the TBRs 521B, C, M, Y being suitably biased by power supply 552. Preferably, each TBR 521B, C, M, Y has an outer diameter of about 44 millimeters and includes a stainless steel core coated with a blanket layer having characteristics and properties similar to layer 362 of roller 300, which blanket layer is preferably 6 mm thick, although any suitable blanket thickness may be used (core and blanket layer not separately illustrated).

As is known in the art, each of the secondary transfers may be aided by a wrap of the RTW 516 around a portion of the respective intermediate image transfer member drum 508B, C, M, Y, and consequently a receiver member adhered to RTW 516 will be similarly wrapped as it passes through each of the modules. The wraps include pre-nip and post-nip wraps which may be produced under tension by supporting members, such as for example the skids 575*a*, 575*b*, 575*c*, 575*d* and 575*e*. The length of each respective pre-nip and post-nip region of wrap does not include the contact area of the actual nip, i.e., does not include the zone where the respective TBR 521B, C, M, Y contacts the back side of RTW 516. In apparatus 500, it is preferred that the length of the respective pre-nip wrap is in a range of approximately 0 mm–6 mm, and more preferably, about 3 mm. It is preferred that the length of the respective post-nip wrap is in a range of approximately 0 mm–6 mm, and more preferably, about 0 mm. Pre-nip and post-nip wraps are especially useful for rough or heavily textured receiver members, inasmuch as transfer efficiency is generally advantageously improved, and lower transfer voltages can be used than would otherwise be the case had no wrap been present.

As is well known, the colored pigments can overlie one another to form areas of colors different from that of the pigments. Secondary transfer of a toner image to a receiver member, e.g., in nips 510B, C, M, Y, is accomplished with a preferred nip width in a range of approximately 2–8 mm, and more preferably, 2.5–4.5 mm. The secondary transfers are preferably done using a lineal pressure greater than about 1.4 pounds per linear inch (pli), and more preferably using a lineal pressure in a range of approximately 2.5–5.6 pli (lineal pressure measured along the nip direction parallel to the respective ITR and TBR axes). The receiver member, e.g., 512*d*, exits the last nip 510Y and is transported by a suitable transport mechanism to a fusing station (transport mechanism and fusing station not shown in FIG. 3) where the marking particle image is fixed to the receiver member by application of heat and/or pressure and, preferably both. A detack charger 524 may be provided to deposit a neutralizing charge on the receiver member to facilitate separation of the receiver member from the RTW 516. After fusing, the receiver member with the fixed marking particle image is then transported to a remote location for operator retrieval. Each respective ITM is cleaned by a respective cleaning device 504B, C, M, Y to prepare it for reuse. Image transfers in each module, both primary and secondary, are effected without application of heat so that there is no fusing or sintering of the toner images transferred to the receiver member until the receiver member enters the fuser. The toners used are preferably those having a glass transition temperature higher than the temperature under which transfer takes place in both the primary and secondary transfer nips.

The receiver members utilized with the modular apparatus 500 can vary substantially. For example, they can be thin or thick, including various paper stocks, transparency stocks, plastic sheet materials, and foils.

Appropriate sensors (not shown) of any well known type, such as mechanical, electrical, or optical sensors for example, are utilized in the printer to provide control signals for the printer. Such sensors may be located along the receiver member travel path between the receiver member supply through the various secondary nips to the fusing station. Further sensors may be associated with the primary image forming member photoconductive drum, the intermediate image transfer member drum, the transfer backing member, and various image processing stations. As such, the sensors detect the location of a receiver member in its travel path, and the position of the primary image forming member photoconductive drum in relation to the image forming processing stations, and respectively produce appropriate signals indicative thereof. Such signals are fed as input information to the logic and control unit LCU including a microprocessor, for example. Based on such signals and a suitable program for the microprocessor, the control unit LCU produces signals to control the timing operation of the various electrostatographic process stations for carrying out the imaging process and to control drive by a motor M of the various drums and belts. For example, motor M as shown applies drive to a drive roller 513 for driving the RTW 516, with the RTW 516 also supported by an idler roller 514 and by other members such as skids 575*a*, 575*b*, 575*c*, 575*d* and 575*e*. The production of a program for a number of commercially available microprocessors, which are suitable for use with the invention, is a conventional skill well understood in the art. The particular details of any such program would, of course, depend on the architecture of the designated microprocessor.

In a preferred embodiment of modular apparatus 500, the ITRs 508 B, C, M, Y are frictionally driven by contact with the moving RTW 516, and the PEFRs 503 B, C, M, Y are frictionally driven by the ITRs 508 B, C, M, Y. RTW 516 is cleaned of foreign matter, e.g., by use of blade cleaning stations 560 and 562. RTW 516 is moved at a speed of at least 300 millimeters/sec (11.7 ips). A preferred outer diameter (OD) of ITR 508 B, C, M, Y is 174 millimeters, although any suitable OD may be used.

The preferred image writer 506B, C, M, Y is an LED device, such as described for example by Y. S. Ng et al., Imaging Science and Technology, 47th Annual Conference Proceedings (1994), pp. 622–5. See also Y. S. Ng, Non-Impact Printing Conference NIP 14, Tutorial A-8, October, 1998 (Publ. Imaging Science and Technology, Springfield, Va.). Preferably, as described in the Tai et al. patent (U.S. Pat. No. 5,258,849), a "mixed dot" halftone dot arrangement is employed in the LED device 506B, C, M, Y. The U.S. Pat. No. 5,258,849 teaches "full dot" construction and "partial dot" construction, wherein "full dot" is a hard dot construction, "partial dot" is a soft dot construction, and the preferred "mixed dot" construction uses both the "full dot and " partial dot" concepts to optimize each of the image writers (e.g., 506B, C, M, Y) used in apparatus 500. A preferred image writer 506B, C, M, Y provides 8-bit grey level image rendering, preferably using a line dot profile as described in the Tai patent (U.S. Pat. No. 5,258,850). Alternatively, a circular dot profile or elliptical dot profile may be used, or a different number of bits may be used for the image rendering.

The preferred 8-bit grey level image rendering by image writer 506B, C, M, Y employs a bit map which can be programmed so as to determine an imaging resolution of a toner image produced by a given writer. The imaging resolution or screen frequency of toner images produced by the modular apparatus 500 has an upper limit (screen frequency may be measured as lines per inch, or lpi). This upper limit is determined by the physical spacing apart of the individual laser diodes included in the image writer. In the present instance, this spacing is preferably (1/600) inch, and the bit map can therefore be programmed to create screen pitches larger than (1/600) inch and screen frequencies less than or equal to 600 lpi. Alternatively, the writer 506B, C, M, Y may be constructed so as to have an inherent physical resolution which corresponds to a maximum screen frequency greater than 600 lpi. Moreover, as is well known, a respective bit map also determines a respective screen angle for toner images corresponding to each of the individual LED writers 506B, C, M, Y. An optimized screen angle is used for each single-color toner image included in a multicolored image produced by the modular apparatus 500. Typically, the screen angles used for the various single-color toner images form an inter-related set, such as for example the type of set used in conventional lithography to form rosette patterns. The entire set may be characterized by an angle of rotation, a, of one of the screens from a specific direction, e.g., a direction parallel to one of the edges of a receiver sheet.

In an embodiment of modular apparatus 500, operational parameters of the respective image writers 506B, C, M, Y are characterized by pre-optimized writer aim values, e.g., pre-optimized screen frequency, pre-optimized screen angle, and pre-optimized dot type for the respective writers, as well as a pre-optimized angle $\alpha$ of rotation of the screen set. In this embodiment, pre-optimized writer aim values are independent of the type of transferee surface of a receiver member passing through the modules. In addition to the abovementioned preferred use of pre-optimized "mixed dot" image rendering, it is also preferred in this embodiment to use the following nominal pre-optimized imaging screen frequencies for forming electrostatic images by image writers 506B, C, M, Y: 212 lpi for black, 158 lpi for cyan, 158 lpi for magenta, and 141 lpi for yellow, respectively. It is more preferred, for printing on a wide variety of receiver surfaces, to use an aim screen frequency of about 155 lpi for all the colors, i.e., black, cyan, magenta, and yellow. However, for printing on certain rough surfaces, such as for example a book cover cloth surface, the inventors have found that even lower screen frequencies are preferable for all the colors, with screen frequencies as low as 133 lpi, or even lower. It is thought that lower screen frequencies permit some "bridging" of toner across some of the hill-and valley structure of a textured transferee surface. Note that certain special receiver members could have areas of different surface roughnesses, or areas requiring different types of images, e.g., embossing for a logo, etc, for which this embodiment is advantageous, especially when employing the lower screen frequencies. Alternatively, the writer may be adjusted in real time so as to use different screen frequencies for different surface roughnesses or for different types of images on the same receiver member sheet.

In alternative embodiments, different writer aim values may be used for different types of transferee surfaces, e.g., for receiver members having different surface topographies characterizable by different surface contour parameters. In these alternative embodiments, the operational parameters of the image-writers are operationally alterable as required by the type of transferee surface used. Thus, operational parameters such as the screen frequency and dot type of the respective image writers may be adjusted, e.g., by using a computer look-up table to provide to the image writer pre-optimized operational parameters for known types of receiver member surface used in the printer. Such adjusting may be done for all image writers similarly, or it may be done for individual image writers as required. Moreover, the angle of rotation of the screen set, $\alpha$, can be operationally adjustable for different types of receiver member surface, e.g., from a computer look-up table. Thus, for a certain type of receiver member transferee surface exhibiting a texture having a pronounced directionality or structure, an optimal value of a may be chosen, e.g., from a computer look-up table, so as to control an influence of this directionality or structure as perceived in color prints, e.g., by a viewer. In yet other alternative embodiments, a locally variable amount of imaging exposure produced by a respective image writer may in certain cases be determined by the transferee surface topography of a receiver member sheet, which locally variable amount of imaging exposure can be used to control a corresponding resulting toner thickness variation within the toned area of a print and thereby improve image quality, e.g., by making electrostatic transfer of toner images more uniform and more efficient. For these yet other alternative embodiments, transferee surface topography characteristics can be pre-known for a certain type of receiver member, or the surface topography characteristics may be measurable, e.g., by a suitable scanning technique, allowing corresponding local exposure adjustments to be programmed into the respective writer algorithm for that particular type of transferee surface.

FIG. 1 shows a preferred fusing station 10 for use in conjunction with the modular apparatus 500. Fusing station 10 includes an internally heated, relatively compliant pressure roller 28 and a relatively unyielding elastomeric fuser roller 23. A receiver member 40 carrying an unfused multicolor toner image 41 is shown approaching fusing nip 30 in direction of arrow C, which fusing nip is formed by fuser roller 23 and pressure roller 28 engaged for applying heat and pressure so as to fuse image 41 to receiver member 40. As shown, fuser roller 23 is heated internally by a longitudinally disposed heating lamp 44 located within cavity 45 formed by the interior of a hollow metallic core 23' of fuser roller 23, which lamp is connected to a power supply (PS) 47 controlled by a control circuit 46 (see FIG. 2(*b*) for details of an exemplary fuser roller). Alternatively, the fuser roller 23 can be heated by an external heat source, e.g., by one or more heated rollers riding along the surface of fuser roller 23, which external heat source may replace or merely assist the internal lamp 44. A wicking device 32 includes a wick 36 in contact with a liquid release agent 33 contained in reservoir 34. Wick 36 absorbs the release agent 33 and transfers the release agent to a metering roller 48, with the amount of release agent on the surface of roller 48 controlled by blade 49. Metering roller 48 is in contact with a release agent donor roller 47, which release agent donor roller contacts fuser roller 23 and thereby delivers to the surface of the fuser roller a continuous flow of release agent 33. Approximately 1–20 milligrams of release agent is needed for each receiver passing through nip 30. As is well known, a suitable release agent is typically a silicone oil. A preferred polymeric release agent 33 for use in fusing station 10 is an amine-functionalized polydimethylsiloxane having a preferred viscosity of about 300 centipoise (see U.S. Pat. No. 6,190,771).

Figure 2A:
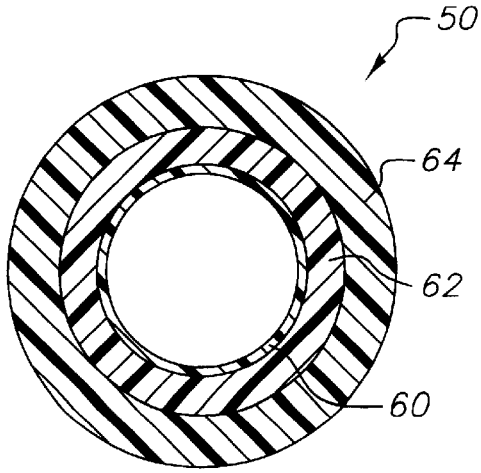
FIG. 2(*a*) shows a side elevational view of a preferred release agent donor roller for use in the fusing station of FIG. 1.
Figure 2B:
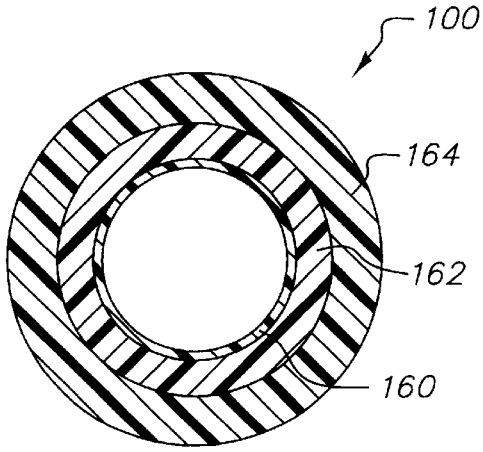
Figure 2C:
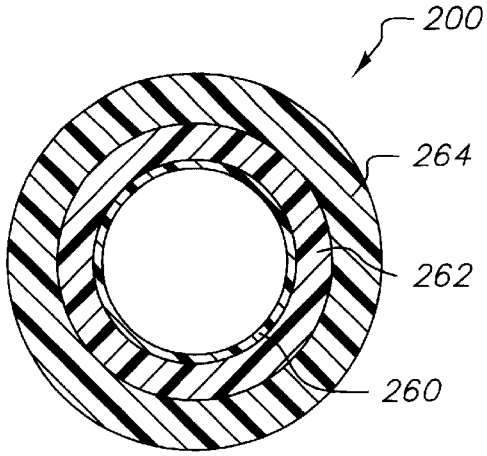

A preferred release agent donor roller for use in fusing station 10 is indicated by numeral 50 in FIG. 2(*a*). Release agent donor roller 50 includes a hollow aluminum core 60, on which core is coated a cushion layer 62 made of a compliant material having a low thermal conductivity obtainable commercially as S5100 from Emerson and Cuming (Lexington, Mass.). A release layer 64 is coated on cushion layer 62. Release layer 64 is preferably made from an interpenetrating network composed of a crosslinked fluoroelastomers and two different silicone elastomers (see U.S. Pat. No. 6,225,409). Core 60 preferably has outer diameter of about 0.875", cushion layer 62 is preferably about 0.230" thick, and release layer 64 is preferably about 0.0025" thick, although the core, cushion layer, and release layer may have different dimensions as may be suitable.

A preferred fuser roller, for use in fusing station 10, is indicated by numeral 100 and is shown in cross section in FIG. 2(*b*). Fuser roller 50 includes a 0.25" thick hollow aluminum core 160 on which core is coated a base cushion layer 162 made of a thermally conductive red rubber obtainable as EC4952 from Emerson and Cuming (Lexington, Mass.), with an outer release layer 164 coated on the base cushion layer. Base cushion layer 162 preferably has a thermal conductivity in a range of approximately 0.35–0.45 BTU/° F./ft/hr, a Shore A hardness in a range of approximately 60–70 and more preferably approximately 65, and Young's modulus in a range of approximately 400–600 psi. Outer release layer 164, which is preferably very thin for adequate toner glossing and release after fusing, is preferably made from a terpolymer of vinylidene fluoride, tetrafluoroethylene and hexafluoropropylene (see Jiann Hsing Chen, et al., U.S. Patent application Ser. No. 09/607,418 filed on Jun. 30, 2000). Alternatively, outer release layer 164 may be made of an interpenetrating network composed of a crosslinked fluoroelastomers and two different silicone elastomers (see U.S. Pat. No. 6,225,409). Core 160 preferably has outer diameter of about 6.00", base cushion layer 162 is preferably about 0.125" thick, and outer release layer 164 has a preferred thickness in a range of approximately 0.0010"–0.0025" thick, although the core 160, base cushion layer 162, and outer release layer 164 may have different dimensions as may be suitable.

A preferred pressure roller for use in fusing station 10 is indicated by numeral 200 in FIG. 2(*c*). Pressure roller 200 includes a hollow aluminum core 260, on which core is coated a compliant layer 262 made of a material having a low thermal conductivity obtainable commercially as S5100 from Emerson and Cuming (Lexington, Mass.). An outer layer 264 is coated on compliant layer 262. Outer layer 264 is preferably made from a terpolymer of vinylidene fluoride, tetrafluoroethylene and hexafluoropropylene (see Jiann Hsing Chen, et al., U.S. patent application Ser. No. 09/607,418, filed Jun. 30, 2000). Alternatively, outer layer 264 may be made of an interpenetrating network composed of a crosslinked fluoroelastomers and two different silicone elastomers (see U.S. Pat. No. 6,225,409). Core 260 preferably has outer diameter of about 3.50", compliant layer 262 is preferably about 0.200" thick, and outer layer 264 is preferably about 0.0025" thick, although the core, cushion layer, and outer layer may have different dimensions as may be suitable. Preferably, compliant layer 262 has a Shore A hardness in a range of approximately between 35–45, and more preferably, approximately 40.

In an embodiment of fusing station 10 for use in conjunction with modular apparatus 500, an engagement between pressure roller 28 and fuser roller 23 forming nip 30 and a lineal pressure along nip 30 are characterized by pre-optimized fuser nip aim values of these quantities. These pre-optimized fuser nip aim values in this embodiment are independent of the type of transferee surface of a receiver member passing through the modules, and also independent of receiver member thickness. In an alternative embodiment, different fuser nip aim values, i.e., different engagement and different lineal pressure along the fusing nip may be used for different types of transferee surfaces, e.g., for receiver members having different surface topographies characterizable by different surface contour parameters. Similarly, different engagements and different lineal pressures along the fusing nip may be used for receiver members having differing thicknesses, i.e., the engagement is generally decreased for thicker receiver members and generally increased for thinner receiver members. Moreover, there will generally be an optimum engagement for a given type of receiver member characterized by a certain thickness combined with particular transferee surface contour parameters. In this alternative embodiment, the engagement and lineal pressure along the fusing nip are operationally adjustable, as required, for a given combination of receiver member thickness and transferee surface topography, e.g., by sending a signal from a computer or a logic and control unit to activate a suitable mechanism for adjusting the engagement of the fusing nip. Thus, in a print run in which all receiver members are of the same type, i.e., have the same nominal thickness and the same nominal transferee surface characteristics, the engagement of the fusing nip is suitably adjusted at the beginning (and end) of the run, e.g., by using a look-up table in the computer, which look-up table stores optimized values of engagement for different types of receiver member. Or, if a group of prints includes receiver members of different types, such as for example text sheets and covers for a booklet, a look-up table can be used as the source of the signal for adjusting the engagement of the fusing nip in real time in the inter-frame between individual receiver member sheets of different types, i.e., during the time interval after a receiver member sheet has moved out of the fusing nip and a new receiver member sheet of a different type is about to enter. It will be evident to those skilled in the art that in order to fuse toner on thicker receiver members when using an internally-heated fuser, nip pressures and nip widths in the fusing nip are generally required to be in the higher ranges of the preferred ranges (see next paragraph) so as to effect sufficient heat transfer for proper fusing.

In the fusing station 10, a dwell time of a receiver member in fusing nip 30 is preferably in a range of approximately 0.02 seconds–0.10 seconds, and more preferably, 0.054–0.067 seconds. A nip width of fusing nip 30 is preferably in a range of approximately 6 mm–30 mm, and more preferably, 16.5–19.5 mm. An engagement in the fusing nip 30 is preferably in a range of approximately 0.5 mm–2.0 mm, and more preferably, 0.9–1.4 mm. A preferred operating temperature in fusing nip 30 is in a range of approximately 100° C.–200° C., and more preferably, 140°–180° C. A preferred lineal pressure in fusing nip 30 is in a range of approximately 10 pli–80 pli, and more preferably, 30 pli–60 pli.

It is found that station 10 works well in fusing toner images to textured papers, and it is believed that this is due to the very long dwell times and the very macrocompliant fusing nip used in the subject invention. Moreover, fuser roller 23 is microcompliant enough so as to be able to contact toner particles located in the valleys of a textured paper, and a wide fusing nip (e.g., about 18 mm wide in a direction parallel to the direction of motion of a receiver through the fusing nip) typically provides a long enough contact time for melting and fixing these particles to a textured or a rough paper.

Modular apparatus 500 advantageously has a substantially straight path for receivers moving through the modules. Such a path is preferred, and is especially useful for certain rough receivers including heavier stocks which may be stiff or relatively unbendable. Moreover, in a printer including apparatus 500 in conjunction with fusing station 10, it is preferable to provide large radius turns when it is necessary to cause a change of direction of motion of a moving receiver being transported through the printer, which large radius turns are clearly advan- tageous for heavier or stiffer stocks.

In response to at least one signal determined by a given type of transferee surface, the fusing subsystem or one or more imaging subsystems included in the image-forming modules can be selectively operationally adjustable by corresponding adjusting mechanisms so as to increase an image quality of a fused color print, the adjusting mechanisms being activated by such signals. Thus, the receiver member reservoir or supply for supplying receiver member sheets (e.g., in direction of arrow A of FIG. 3) may include one or more paper types such that individual receiver members, as they leave the reservoir, are automatically recognized by a recognition mechanism (not illustrated) which recognition mechanism sends a signal to a computer, e.g., a miniprocessor, which computer in turn uses a look-up table to thereby send appropriate signals for selectively adjusting relevant subsystem set points and fusing station engagement in manner as described above. The recognition mechanism may include an optical device, e.g., a scanner, as is well known. Alternatively, the receiver member reservoir may for example include different drawers for different types of papers, with each drawer keyed to the computer or miniprocessor such that a signal is sent to the computer when a given type of sheet leaves a corresponding drawer. As another alternative, an operator of the printer may provide the signal, e.g., by use of a keypad, to key in one or more code numbers for different types of receiver members as well as providing the order and number of pages of each type of receiver member in a given job.

For the Examples below, fused toner images were made according to the invention on various types of receiver members having transferee surfaces with different degrees of smoothness, which receiver members include for example very smooth papers such as for example clay-coated papers, patterned or textured papers such as for example papers having a linen-like finish, and rough papers such as those used for example for book covers. A representative list of receiver members is given in Table 1, which list also gives typical ranges of weights of receiver members, e.g., in grams per square meter (second column). Table 1 also shows typical roughness values in Sheffield Units (third column). Not all of the receiver members listed in Table 1 were tested. For example, newsprints were not tested, inasmuch as a high quality printer of the invention would not have a practical application for printing on such low quality receiver members.

TABLE 1

Representative Receivers

| Receiver Member | Weight | Sheffield Number† | Manufacturer |
|---|---|---|---|
| Newsprint (old style) | | 225–250* | Various |
| Newsprint (new style) | | 150–180* | Various |
| Bristol Vellum (rough business card paper) | | 225–300* | Various |
| "Laser Xerographic" (paper) | | 50–70* | Various |
| "Regular Xerographic" (uncoated paper) | | 180–200** | Hammermill (Div. of Int'l. Paper Co.) Purchase, NY |
| Classic Linen Light (textured paper) | 118 $g/m^2$ (32 lb) | 267** | Neenah, Roswell, GA |
| Classic Linen Heavy (textured paper) | 232 $g/m^2$ | 296** | Neenah, Roswell, GA |
| Classic Laid Cover (rough paper) | 216 $g/m^2$ (80 lb) | 417** | Neenah, Roswell, GA |
| Lustro Gloss or Spectrotech Lustro Laser (clay-coated paper) | 118 $g/m^2$ | 10** | Sappi North America Boston, MA |
| Navajo Brilliant White (paper) | 118 $g/m^2$ | 41–44** | Mohawk Paper Mills Inc. Cohoes, NY |
| Ikono Silk (coated paper) | 170 $g/m^2$ | 42** | Zanders Feinpapiere AG (Div. of Int'l. Paper Co.) Purchase, NY |
| Strathmore Writing Cover Bristol Ultimate Whitewove | 236 $g/m^2$ | | Strathmore Paper Co. West Springfield, MA |
| Igepa Fauna RC (paper) | 240 $g/m^2$ | 407** | Cartiera Cordenons SpA Milano, Italy |
| Digitex 160 book cover material (cotton fiber reinforced) | 180 $g/m^2$ | 117*** | IGC Corporation Kingsport, TN |
| Digitex 220 book cover material (poly-cotton reinforced) | | | IGC Corporation Kingsport, TN |
| Digitex 380 book cover material (poly-cotton reinforced) | 383 $g/m^2$ | 267*** | IGC Corporation Kingsport, TN |

†Sheffield Number (measured in Sheffield units): see, e.g., G. A. Hagerty et al., TAPPI Journal, Jan. 1998, pp. 101–106, as well as the Background to the Invention.
*Typical Ranges: Values may vary from one manufacturer to another, and also from lot to lot.
**Experimentally measured values
*Manufacture's data Experimentally measured values of Sheffield Numbers, including those identified with a double asterisk () in Table 1, were obtained using a Sheffield Precisionaire device manufactured by the Warner and Swasey Company and equipped with a "porosimeter" and a "smoothcheck" head, the test method being TAPPI T538.

EXAMPLE 1

Mottle Measurements for Various Paper Receiver Members This example demonstrates that an image quality metric, e.g., mottle, can be related to surface roughness and more specifically to the surface topography or surface contour characteristics of a transferee surface of a receiver member for use in the invention. The mottle (undesirable in an image) is measured in flat-field toned areas on a variety of receiver members after nominal fusing, with conditions and set points in the printer being the same for each of the receiver members tested. Mottle measurements were made with a Tobias and Associates Mottle Tester, Model MTI. A Mottle Index as measured by this machine (in mottle units) is calculated from an algorithm developed by Tobias Associates, as described in P. E. Tobias et al., TAPPI Journal, Vol. 72 (No. 5), pp. 109–112 (1989).

Experiments were conducted in the printer with the various elements of the relevant subsystems being in nominal conditions, by which it is meant that setpoints for operation of the subsystems, and the dimensions, characteristics and properties of these elements are included in the preferred values which are disclosed above for fusing station 10, donor roller 50, fuser roller 100, pressure roller 200, intermediate member 300, and modular apparatus 500. The nominal conditions were the same for all the experiments of this example. In particular, a black toner was used having 0.7% wt/wt silica surface additive, the screen frequency was 212 lpi, the secondary transfer current was 25 $\mu$a, the lineal pressure in the secondary transfer nip was 2.69 pli, the blanket layer in the intermediate transfer roller was 10 mm thick with a Young's modulus of 4 megapascals, and the blanket layer was coated with a ceramer overcoat 4 $\mu$m thick having a Young's modulus of 1.2 gigapascals.

Figure 5A:
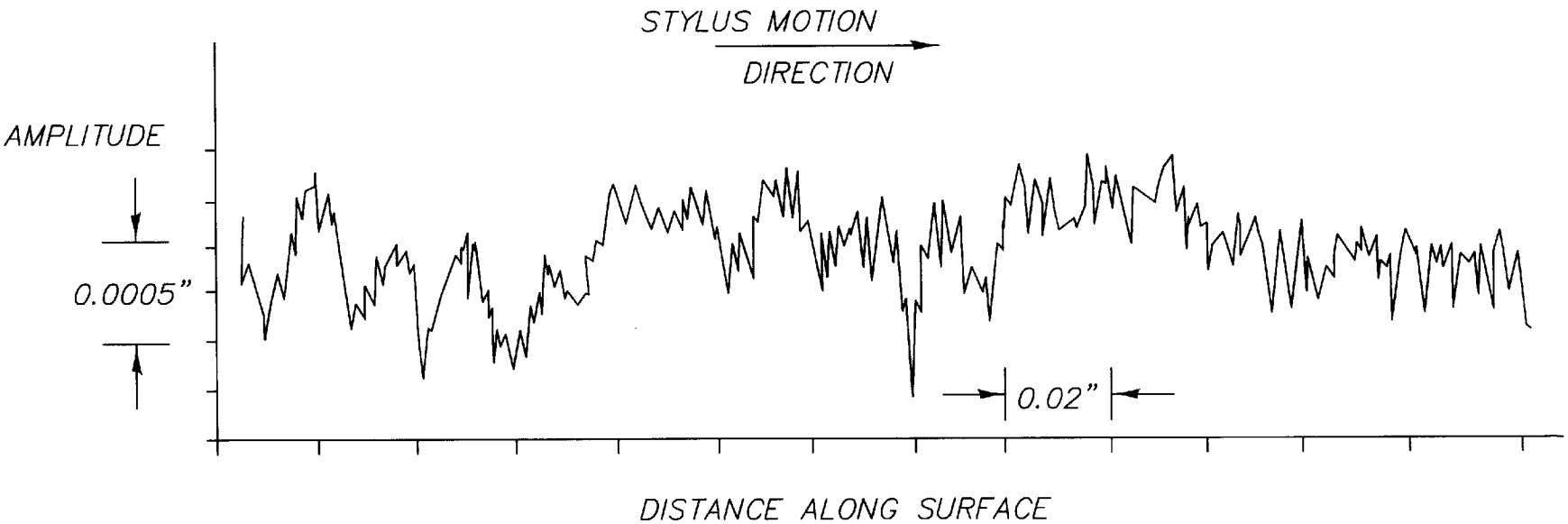
FIG. 5(*a*) is a surface profilometry trace of a transferee surface of a Classic Linen paper receiver member.
Figure 5B:
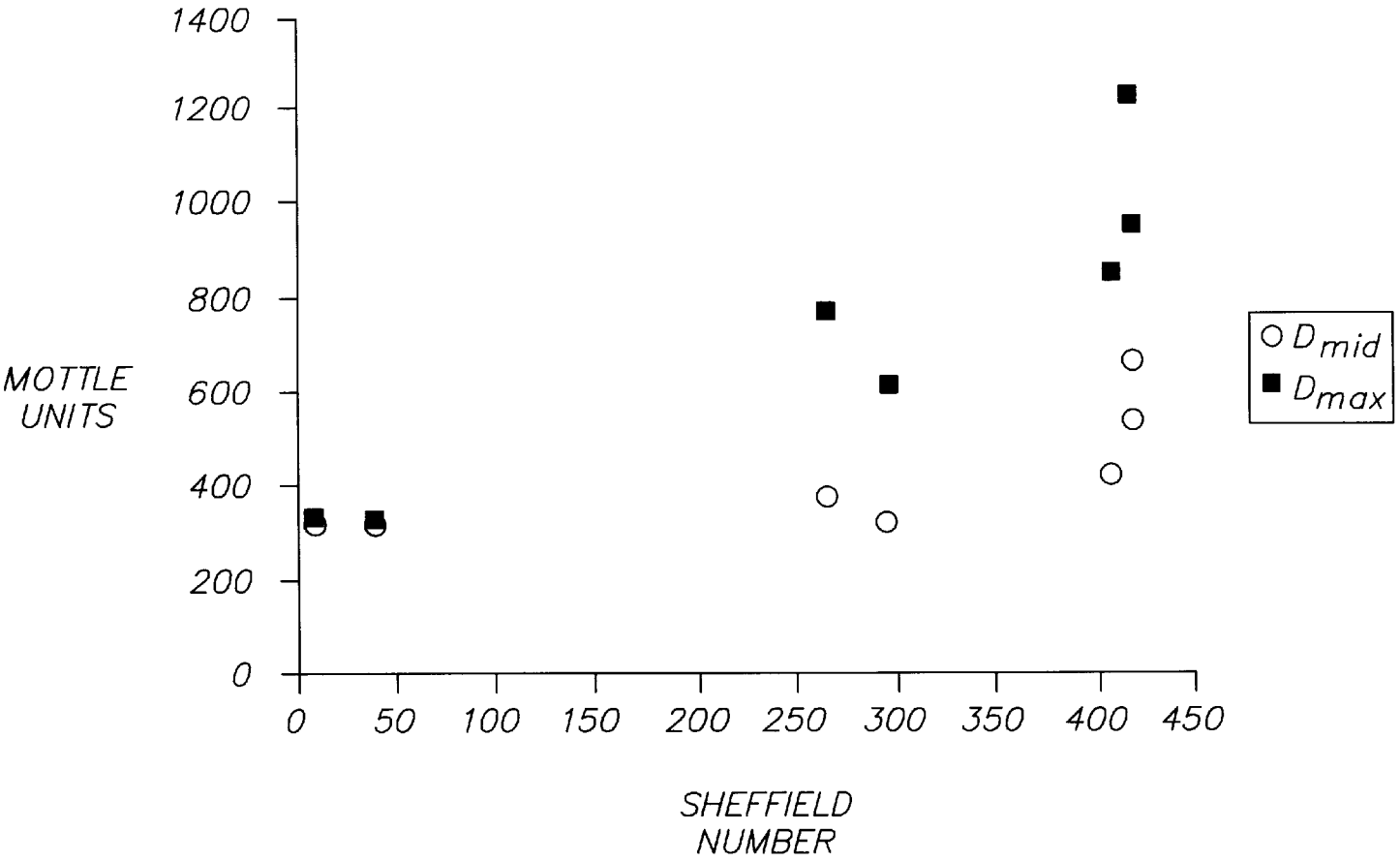
Figure 5C:
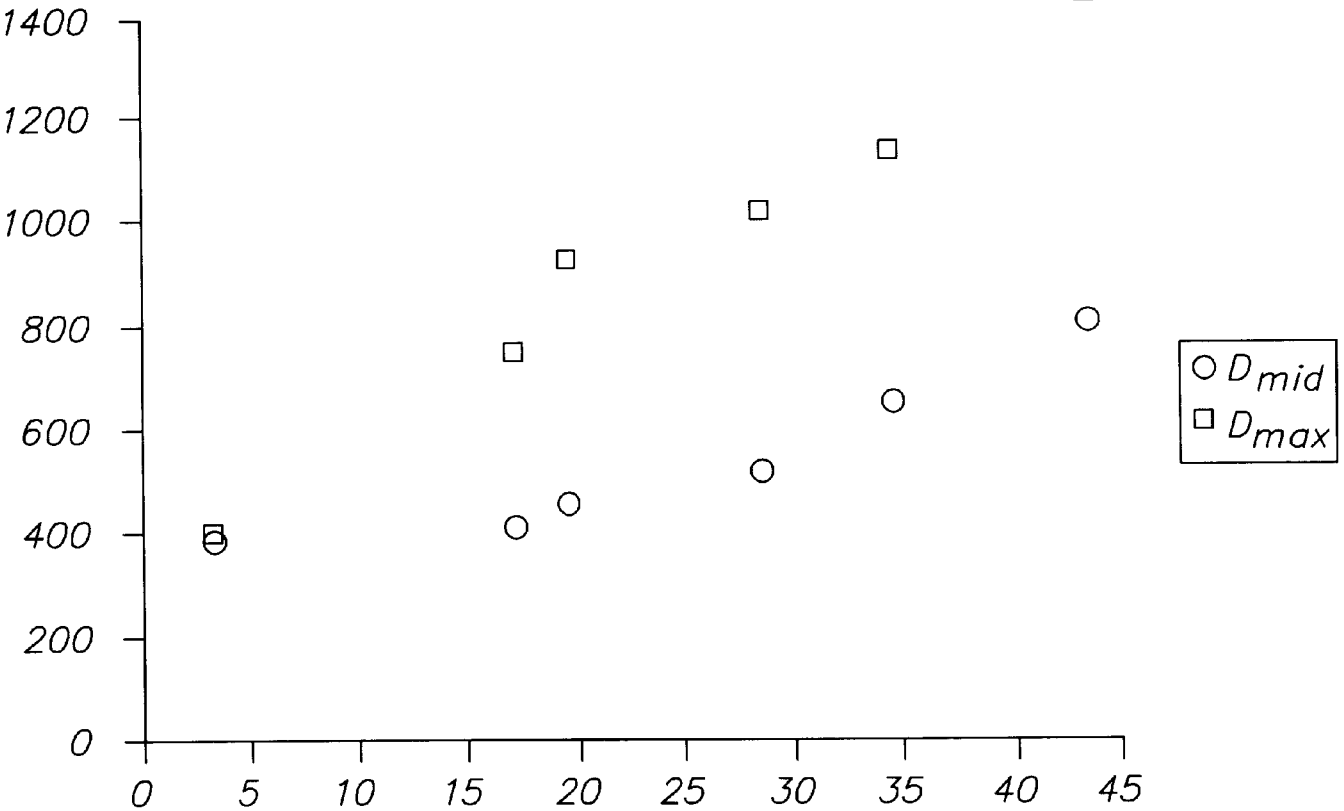

FIG. 5(*a*) shows a typical profilometry scan of the transferee surface of an unused sheet of Neenah Classic Linen (heavy) paper (see Table 1). Such profilometry scans are useful for characterizing surface contour properties and for relating microtopography to image quality metrics such as image mottle. The scan of FIG. 5(*a*) was made using a Gould Microtopographer stylus instrument employing a 2.5 $\mu$m radius diamond tip with a 90 degree included angle and a 50 milligram load, calibrated to specimen #2071 traceable to the National Institute of Standards and Technology (NIST). From a single profile scan, various numerical quantities or surface contour parameters (e.g., MPE, Ra, Rz, 10 PT, PPI, Ar, and Rq, as defined in *Surface Texture* (*Surface Roughness, Waviness and Lay*), ASME B46.1-1995) can be calculated using an associated computer. In particular, MPE (Maximum Peak Excursion) is the largest adjacent peak-to-valley distance measured in microinches. Mottle-related data for a number of the receivers of Table 1 are provided in Table 2, which table gives scan-related data as well as data obtained from toned, fused prints made by the printer under the conditions described above.

TABLE 2

Mottle-Related Data for Various Receiver Members

| Receiver Member | Scan-Derived Surface Contour Characteristics (measured on bare transferee surfaces) Ra | Rz | MPE | 10 PT | Mottle Index (flat-field prints) Dmid (mottle units) | Dmax (mottle units) |
|---|---|---|---|---|---|---|
| Classic Linen Heavy | 3.807 | 20.35 | 14.66 | 22.19 | 337 | 632 |
| Igepa Fauna RC | 4.417 | 24.73 | 24.01 | 25.93 | 435 | 866 |
| Classic Linen Light | 2.961 | 17.82 | 16.66 | 19.59 | 380 | 780 |
| Classic Laid Cover (1)* | 4.005 | 25.24 | 28.87 | 27.76 | 552 | 973 |
| Classic Laid Cover (2)* | 5.469 | 32.46 | 36.34 | 34.85 | 678 | 1232 |
| Lustro Gloss | 0.508 | 3.51 | 3.27 | 3.72 | 326 | 336 |
| Ikona Silk | 0.483 | 3.28 | 3.10 | 3.56 | 321 | 337 |

*(1) measured parallel to long side of rectangular sheet (cross-track direction in machine)
*(2) measured parallel to short side of rectangular sheet (in-track direction in machine)

FIG. 5(*b*) shows a graph of flat-field mottle (Mottle Index) measured for a variety of toned and fused receiver members, the mottle (in mottle units, see Table 2) plotted against corresponding experimentally measured Sheffield Numbers (as listed in Table 1). Mottle was measured for a black mid-density reflection density (Dmid, approximately 0.6) and for a black maximum reflection density such as would be used in an image (Dmax). It is seen that as Sheffield Number increases (roughness increases) the image mottle generally increases, and that the amount of mottle is larger for Dmax than for Dmid. However, the measured mottle does not correlate particularly well with Sheffield Number, there being considerable scatter for both the Dmid and Dmax data.

FIG. 5(*c*), also using data from Table 2, shows that image mottle (Mottle Index) correlates strongly with MPE, giving approximately linear relations for both Dmid and Dmax. Image mottle also shows good correlations (not graphed) with other metrics, including the Ra, Rz and 10 PT values tabulated in Table 2. Thus it may be seen that transferee surface contour information derived from bare (untoned) receivers, e.g., such as derived from the scan trace of FIG. 5(*a*), can be useful as a predictor of image mottle for a variety of transferee surfaces.

A test output print including alphanumerics, bar patterns and step-tablets was made at 212 lpi on Neenah Classic Linen (heavy) paper using the same black toner under the same machine conditions, which image showed acceptable mottle except for the lower density step tablets. The alphanumerics and bar patterns for both high and intermediate contrast were crisply and solidly delineated, i.e., were sharp and unbroken.

EXAMPLE 2

Full-color Imaging on Various Receiver Members

Experiments were conducted in the printer with the various elements of the relevant subsystems being in nominal conditions, by which it is meant that setpoints for operation of the subsystems, and the dimensions, characteristics and properties of these elements are included in the preferred values which are disclosed above for fusing station 10, donor roller 50, fuser roller 100, pressure roller 200, intermediate member 300, and modular apparatus 500.

A full-color print on Neenah Classic Linen (heavy) paper was made with a transfer current of 25 $\mu$a during transfers from each intermediate member at 2.69 pli, using the following screen frequencies: 212 lpi for black, 175 lpi for cyan, 175 lpi for magenta, and 150 lpi for yellow. Under typical viewing conditions, the print on this textured paper was excellent and faithfully reproduced the color balance and details of the original input image without objectionable mottle. A control image of the same subject made on very smooth Lustro Gloss paper was not noticeably different. Neenah Classic Linen papers exhibit a surface structure having hills and valleys mainly aligned approximately parallel to both the in-track and cross-track directions in the printer (in-track is for example parallel to the direction of motion of RTW 516 of modular apparatus 500, and cross-track is at right angles to this direction). This result demonstrates that good quality images can be made on this type of "regularly-patterned" receiver member for Sheffield Numbers at least as great as about 300.

Full-color images were also made under the same conditions on Digitex 160 and Digitex 220 receiver members, which exhibit a dimpled surface structure which is "regularly-pattemed" such that there is an array of dimples aligned approximately parallel to both the in-track and cross-track directions in the printer. (Digitex 220, no longer available, has similar surface topography and is similar in composition to Digitex 380, but is of lighter weight). The resulting color prints on Digitex 160 were of very good quality, with excellent fidelity and color balance. Similar prints were obtained on Digitex 220, which is a more deeply dimpled material than Digitex 160, although there were a few image defects caused by incomplete transfers from intermediate members to the deepest portions of a few of the dimples. Thus the printer is shown to produce acceptably high quality color images on cloth-based materials, including materials coated with polymeric material, such as for example Digitex 220.

Full-color prints were also produced on a typical Bristol paper, namely Strathmore Writing Cover Bristol Ultimate Whitewove (see Table 1), which is a randomly-textured, rough, uncoated, business card stock. These prints were made under the same conditions with the exception that the secondary transfer pressure was lower, i.e., 2.22 pli. By direct comparison to an image of the same subject made on Lustro Gloss paper, the results showed subjectively relatively poor image quality with unacceptable mottle. Raising the secondary transfer pressure to 5.06 pli provided a fairly good image quality (marginally acceptable) on the same business card stock, showing that high transfer pressure is preferred for rough, randomly-textured, transferee surfaces.

In general, it is found that lowering the screen frequency improves the image mottle and reduces transfer defects arising from transfer from intermediate members to rough receiver members. Lowering the screen frequency for each color to 155 lpi gave improved results for all the cases described above in this example. Moreover, fairly good images are also obtained at 155 lpi on very rough materials, such as Neenah Classic Laid Cover (Table 1). In particular, mottle is improved at lower screen frequency. Thus, a screen frequency of 212 lpi that was used to generate the data of FIGS. 5(*b,c*) is more appropriate for smooth papers, such as Lustro Gloss and Ikona Silk; corresponding values of Mottle Index for the same receiver members as those of FIGS. 5(*b,c*) are smaller for lower values of screen frequency e.g., for 155 lpi (preferred for the rougher papers) or even lower screen frequency.

In addition to lower screen frequency being preferred for accommodating a wide variety of transferee surfaces, it is also generally found that an improved ability to handle many different kinds of receiver members is achieved by using the larger toner particles in the preferred range of size, by using the higher surface additive coverages on the toner particles in the preferred range of coverage, by using the lower end of the preferred range of Young's modulus or Shore A hardness for the intermediate members, and by using the higher transfer pressures in the preferred range of transfer pressure for transfers from intermediate members to receivers.

EXAMPLE 3

Comparison of Image Writer Dot Profiles Using Several Receiver Members (For Constant Screen Frequency, Several Receiver Members)

Experiments were conducted in the printer with the various elements of the relevant subsystems being in nominal conditions, by which it is meant that setpoints for operation of the subsystems, and the dimensions, characteristics and properties of these-elements are included in the preferred values which are disclosed above for fusing station 10, donor roller 50, fuser roller 100, pressure roller 200, intermediate member 300, and modular apparatus 500 including the image writers. For this example, monocolor ramp images including 255 density levels were made using discharged area development with black or cyan toner at a screen frequency of 150 lpi, using four different dot profiles and three different types of paper receiver members, with the object of discovering the effect of dot profile on subjective mottle and tone scale fidelity. It was found that the image quality of the cyan images was at least as good as that of the black images, and so only tests with black toner are reported.

Four dot profiles were used, including continuous tone (contone), a soft dot profile, a mixed dot profile (see U.S. Pat. No. 5,258,849), and a hard dot profile. The receiver members used were Lustro Gloss, Navaho Brilliant White, and Classic Linen Heavy(Neenah). To subjectively evaluate the ramp images under typical viewing conditions, arbitrary scales were created having a range 0–100 (arbitrary units).

The results are collected in Tables 3, 4, and 5.

TABLE 3

Subjective Mottle Evaluation* for Different Dot Profiles (Black Toner) (Range of image density-Dmid to Dmax)

| Dot Profile | Lustro Gloss | Navaho Brilliant White | Classic Linen Heavy (Neenah) |
|---|---|---|---|
| contone | 10 | 50 | 40 |
| soft dot | 10 | 60 | 40 |
| mixed dot | 5 | 15 | 15 |
| hard dot | 5 | 15 | 10 |

*Low numbers better; "worst case subjective mottle" = 100

Table 3 shows that for all three receiver members, perceived mottle is worse for contone or soft dot profile than for mixed dot or hard dot profiles (a value of zero represents "no detectable mottle" and a value of 100 represents "worst possible" mottle). As would be expected, the perceived mottle is considerably lower for the very smooth Spectro Gloss than for Navaho Brilliant White and Classic Linen. However, perceived mottle for Classic Linen is no higher, and perhaps lower, than for Navaho Brilliant White, even though Navaho Brilliant White is a much smoother paper (Table 1).

TABLE 4

Subjective Visibility* of Texture for Different Dot Profiles (Black Toner)

| Dot Profile | Lustro Gloss | Navaho Brilliant White | Classic Linen Heavy Heavy |
|---|---|---|---|
| contone | 0 | 0 | 80 |
| soft dot | 0 | 0 | 80 |
| mixed dot | 0 | 0 | 65 |
| hard dot | 0 | 0 | 60 |

*Low numbers better; "maximum subjective visibility" = 100

Table 4 indicates that there is negligible visible texture from the substrate for both Lustro Gloss and Navaho Brilliant White (a value of zero represents "no detectable texture" and a value of 100 represents "maximum possible" texture visibility). The substrate texture underlying the toner in the ramp image is very noticeable on the Classic Linen, which is a desirable feature with this receiver member. Both the mixed dot and hard dot profiles resulted in a lower perceived texture in toned areas than did the contone and soft dot profiles (column 4). Advantageously, the toner deposit on the Classic Linen was found to be substantially continuous over the hills and valleys for this screen frequency (150 lpi).

TABLE 5

Approximate Length of Tone Scale (mm)* For Different Dot Profiles (Black Toner)

| Dot Profile | Lustro Gloss | Navaho Brilliant White | Classic Linen Heavy Heavy |
|---|---|---|---|
| Contone | 233 | 237 | 236 |
| soft dot | 231 | 235 | 232 |
| mixed dot | 249 | 251 | 248 |
| hard dot | 247 | 248 | 249 |

*Maximum length of tone scale on receiver member = 260 millimeters

Table 5 shows the extent of the toner deposits in the ramp images, with the measured lengths starting at the Dmax end of each ramp. In all cases tested, the density of the toner deposit in the ramp image became negligible some millimeters from the low density end of the ramp, which is an indication that toner transfer for the lowest densities was incomplete. The greater extent of the density range for the mixed and hard dot profiles as compared to the contone and soft dot profiles is thought to be caused by dot gain, the dot gain being produced primarily by the fusing station. Thus it is preferred to use contone or soft dot profiles for more faithful tone scale reproduction. It should be noted that in embodiments of the invention in which exposure algorithms of the image writers can be adapted to given types of receivers, this type of dot gain can be corrected for in the writer. Advantageously, for each of the dot profiles, there was no extra loss of density range when using the textured Classic Linen as compared to the much smoother Lustro Gloss and Navaho Brilliant White.

The results given in Tables 3–5 show that the mixed dot profile provides the optimum imaging on the three receiver members when considering mottle, substrate texture visibility, and tone scale.

EXAMPLE 4

Effects of Silica Coverage and Secondary Transfer Pressure on Image Mottle

Experiments were conducted in the printer with the various elements of the relevant subsystems being in nominal conditions, by which it is meant that setpoints for operation of the subsystems, and the dimensions, characteristics and properties of these elements are included in the preferred values which are disclosed above for fusing station 10, donor roller 50, fuser roller 100, pressure roller 200, intermediate member 300, and modular apparatus 500 including the image writers. For this example, two different silica coverages on a black toner and two different secondary transfer pressures from intermediate member to receiver member were used. The mean toner particle diameter was about 8 $\mu$m. The screen frequency was 212 lpi.

Measured values of Mottle Index (in mottle units) are tabulated in Table 6 for three different receivers for mid-range density patches.

TABLE 6

Mottle Index* for Different Silica Coverages and Transfer Pressures (Black Toner)

| | 0.7% Silica (wt/wt)** | | 1.5% Silica (wt/wt)** | |
|---|---|---|---|---|
| Paper Receiver | 2.8 pli | 5.6 pli | 2.8 pli | 5.6 pli |
| Lustro Gloss | 321 | 312 | 216 | 216 |
| Classic Linen Light | 306 | 303 | 272 | 257 |
| Classic Laid Cover | 665 | 547 | 502 | 545 |

*Weight percent silica as surface additive on toner particles.
**Measurement error ± 40 mottle units; viewing threshold about 50–75 mottle units.

It is concluded from Table 6 that noticeable reductions of mottle can be achieved by using the higher surface concentrations of silica. On the other hand, for mid-range densities, doubling the secondary transfer pressure from 2.8 pli to 5.6 pli had negligible effect on mottle, within the experimental scatter of the data. In separate tests, a significant benefit of increased secondary transfer pressure was found for low-density toner images.

Notwithstanding the above described use of intermediate transfer rollers (e.g., with reference to apparatus 500 of FIG. 3) the subject invention further contemplates direct transfers of toner images to receiver members (i.e., without use of ITRs). A modular printer using such direct transfers (which printer does not include rollers such as 508B, C, M, Y nor the associated cleaning stations 504B, C, M, Y) includes a modular apparatus that is preferably otherwise similar to that of modular apparatus 500. Thus, in such a direct-transfer type of printer (not illustrated), receiver member sheets are adhered, e.g., electrostatically, to a transport web and moved through a plurality of tandem modules to form multi-colored toner images thereon. Single color toner images, formed on primary image forming rollers (e.g., similar to rollers 503B, C, M, and Y) are transferred sequentially to a receiver member moving through the modules, thereby forming a plural or multicolored image on the receiver member. The primary image forming rollers are preferably compliant (see for example U.S. Pat. Nos. 5,715,505 and 5,828,931). Excepting the ITRs 508B, C, M, Y and elements associated with these ITRs, the characteristics and properties of the various elements included in a preferred direct-transfer type of printer are entirely similar to those disclosed above for the preferred embodiment of modular apparatus 500.

For assessing output prints produced by the printer, e.g., for different types of receiver members or for different types of transferee surfaces, it is useful to have as a reference a predetermined nominal image quality which is deemed at least minimally acceptable. The predetermined nominal image quality can include subjective or quantitatively measured evaluations of one or more image metrics, such as for example mottle, tone scale, resolution, sharpness, Dmax, and so forth. A predetermined quantitative nominal image quality, as related to one of these metrics, may be predictable or relatable to certain quantitatively measurable surface contour parameters of the bare transferee surfaces, e.g., as demonstrated by Example 1. Alternatively, quantitative image quality metrics of output prints may be measured by an image quality measuring device, e.g., by a scanner or microdensitometer, or the prints may be otherwise subjected to quantitative measurements of specific image quality characteristics in order to ascertain whether the predetermined quantitative nominal image quality has been attained. On the other hand, the predetermined nominal image quality can be a predetermined subjective nominal image quality, and subjective image quality of output prints can be evaluated, e.g., by viewing prints under known viewing conditions. Subjective evaluations may include comparisons with reference prints, which reference prints exhibit the predetermined subjective nominal image quality, i.e., meet the visual requirements for the particular image characteristics of interest.

The invention has been described in detail with particular reference to certain preferred embodiments thereof, but it will be understood that variations and modifications can be effected within the spirit and scope of the invention.

What is claimed is:

1. A printer for printing color toner images on a receiver member, said receiver member being one or more of a group of materials including paper, polymeric materials including rubbers and plastics, coatings including clay coatings and polymer coatings, fibers including polymer fibers and textile fibers, reinforcing materials, fabrics, and cloth, said receiver member having a transferee surface included in a plurality of types of transferee surface, said plurality of types of transferee surface including smooth, rough, textured, patterned, reinforced and woven surfaces, said printer comprising:

a number of tandemly arranged electrophotographic image-forming modules, a respective image-forming module including a plurality of imaging subsystems for making toner images of a respective single color, said toner images of a respective single color for non-thermally-assisted electrostatic transfer to said receiver member, a toner image of a respective single color formed in said respective module for transfer to said receiver member, said receiver member moved successively through said modules so as to form an unfused color print, said unfused color print thereafter moved through a fusing station included in said printer so as to form a fused color print; and the image quality of said fused color print is selected to be at least as high as a predetermined nominal image quality, said image quality of said fused color print produced by a non-operational co-optimization of fusing station-parameters and imaging subsystem parameters, said non-operational co-optimization enabling said printing on said plurality of types of transferee surface.

2. The printer according to claim 1, said image quality of said fused color print being a subjective image quality, said predetermined nominal image quality being a predetermined subjective nominal image quality, wherein said subjective image quality of said fused color print, as judged by a viewer under known conditions of viewing, is at least as good as said predetermined subjective nominal image quality.

3. The printer according to claim 1, said image quality of said fused color print being a quantitative image quality, said predetermined nominal image quality being a predetermined quantitative nominal image quality, wherein said quantitative image quality of said fused color print, as measured by an image quality measuring device, is at least as good as said predetermined quantitative nominal image quality.

4. The printer according to claim 1, wherein a respective type of transferee surface included in said plurality of types of transferee surface is an untoned surface characterizable by at least one of a respective surface contour parameter and a surface roughness parameter.

5. The printer according to claim 4, wherein said surface roughness parameter is a Sheffield Number, said Sheffield Number having a value in a range between zero Sheffield units and at least approximately 300 Sheffield units.

6. The printer according to claim 1, wherein each of said plurality of imaging subsystems respectively includes a charging station, an image writing station, a development station, and an intermediate transfer station.

7. The printer according to claim 1 wherein at least one imaging subsystem included in said plurality of imaging subsystems is selectively operationally adjustable so as to increase said image quality of said fused color print, said plurality of imaging subsystems including a charging subsystem for charging a photoconductive imaging member, an exposure subsystem for image-wise exposing the photoconductive imaging member, a development subsystem for toning the imagewise exposed photoconductive imaging member, and an intermediate transfer subsystem for transferring toner images from the photoconductive imaging member to an intermediate transfer member and from the intermediate transfer member to receiver members; said charging subsystem selectively operationally adjustable by altering a charging voltage of said photoconductive imaging member; said exposure subsystem including a digital exposure device, said digital exposure device selectively operationally adjustable by adjusting at least one of a dot type, a frequency of a screen, and an angle of rotation of said screen; said development subsystem selectively operationally adjustable by adjusting a development voltage of a development station included in said development subsystem, said development subsystem selectively operationally adjustable by adjusting a toner concentration in a developer included in said development station, said development subsystem selectively operationally adjustable by altering a rate of mechanical motion associated with said development station; and, said intermediate transfer subsystem selectively operationally adjustable by adjusting an engagement in a nip for transferring toner images from said intermediate transfer member to a receiver member, said intermediate transfer subsystem selectively operationally adjustable by adjusting a transfer voltage across said nip.

8. The printer according to claim 1 wherein an engagement, of a pressure roller and a fuser roller included in said fusing subsystem, is selectively operationally adjustable so as to increase said image quality of said fused color print.

9. The printer according to claim 1 wherein, in response to at least one signal determined by a given type of transferee surface included in said plurality of types of transferee surface, at least one imaging subsystem included in said number of tandemly arranged electrophotographic image-forming modules is selectively operationally adjustable by an adjusting mechanism so as to increase said image quality of said fused color print.

10. The printer according to claim 1 wherein, in response to at least one signal determined by a given type of transferee surface included in said plurality of types of transferee surface, said fusing subsystem is selectively operationally adjustable by a fuser adjusting mechanism so as to increase said image quality of said fused color print.

11. A printer for making full-color prints on receiver members having various types of transferee surfaces, which various types of transferee surfaces include smooth, rough, textured, patterned, and woven surfaces, said printer comprising:

a number of tandemly arranged electrophotographic image-forming modules, a module of said printer including a charging station for charging a photoconductive primary imaging member, an image writing station for forming a latent image, a development station for forming a toner image of an single color, and an intermediate transfer station for non-thermally assisted electrostatically transferring said toner image of a single color from said photoconductive primary imaging member to a receiver member moving through said module, said receiver member having a type of transferee surface included in said various types of transferee surfaces, said receiver member moved successively through said modules to form an unfused color print and thereafter through a fusing station included in said printer so as to form a fused color print, wherein:

said charging station charging said photoconductive primary imaging member to a potential, said respective being transferee-surface-dependent at least in part according to said type of transferee surface;

said image writing station exposing said photoconductive primary imaging member by a gray-level halftone digital exposure device so as to form said latent image, said exposing being accomplished at a receiver-dependent maximum exposure per unit area, said gray-level halftone digital exposure device being computer-controlled, so as to control at least one of the characteristics of said latent image selected from the group of a transferee-surface-dependent screen frequency, a transferee-surface-dependent screen angle, a transferee-surface-dependent receiver member-dependent maximum exposure per unit area, and at least one type of respective transferee-surface-dependent exposure profiling for creating profiled dots in said latent image;

said development station for toning said latent image using toner particles having a diameter in a range of approximately 2–9 micrometers, said toner particles including a polymeric binder, said toner particles being surface treated to include a coverage of adhered sub-micron particles, said sub-micron particles having a surface area in a range of about 50–300 $m^2$/gram, said sub-micron particles made of materials including silica, alumina, or titania;

said intermediate transfer station electrostatically transferring, in a primary transfer, said toner image of a respective single color from said photoconductive primary imaging member to a compliant intermediate transfer roller, said compliant intermediate transfer roller including a blanket layer coated on an aluminum drum, said blanket layer having a thickness in a range of approximately 5–15 millimeters, said blanket layer having a Young's Modulus less than approximately 4.25 megapascals, said blanket layer having a Shore A hardness less than approximately 65, said blanket layer having an electrical resistivity in a range of approximately $10^7$ to $10^{11}$ ohm-cm, said blanket layer overcoated by a ceramer layer having a thickness in a range of approximately 2–10 micrometers, said blanket layer having a resistivity in a range of approximately $10^7$–$10^3$ ohm-cm;

said toner image of a respective single color being electrostatically secondary transferred in said intermediate transfer station, said secondary transfer being from said compliant intermediate transfer roller to said receiver member, said receiver member moved through a respective transfer nip formed between said compliant intermediate transfer roller and a transfer backup roller, said transfer backup roller including a compliant layer of thickness of about 6 coated on a steel drum, said compliant layer of said transfer backup roller characterized by ranges of Young's Modulus, Shore A hardness and electrical resistivity respectively similar to those of said compliant intermediate transfer roller, with a lineal pressure provided of at least about 1.4 pounds per lineal inch along said transfer nip during said electrostatic secondary transfer from said compliant intermediate transfer roller to said receiver member, said respective transfer nip having a nip width in a range of approximately 2–8 mm;

said unfused color print being thermally fused in said fusing station, said fusing station including a heated fuser roller and a pressure roller, which fuser roller and which pressure roller form therebetween a fusing nip, said receiver member passing through said fusing nip, a dwell time in said fusing nip being in a range of approximately 0.02 seconds–0.10 seconds, a nip width of said fusing nip being in a range of approximately 6 mm–30 mm, an engagement in said fusing nip being in a range of approximately 0.5 mm–2.0 mm, an operating temperature in said fusing nip being in a range of approximately 100° C.–200° C., a lineal pressure provided in said fusing nip being in a range of approximately 10 pli–80 pli, said fuser roller having a base cushion layer with Shore A hardness in a range of approximately between 60–70, said pressure roller having a base cushion layer with a Shore A hardness in a range of approximately between 35–45;

wherein values of abovementioned parameters relating to said fusing station and to said imaging subsystem determine a co-optimization of said printer, said co-optimization for enabling said printing on said plurality of types of transferee surface, said enabling providing an image quality of said fused color print at least as high as a predetermined nominal image quality.

12. The printer according to claim 11 wherein:

said transferee-surface-dependent screen frequency has a nominal value of about 212 lines per inch when said respective single color is black;

said respective transferee-surface-dependent screen frequency has a nominal value of about 158 lines per inch when said respective single color is cyan;

said respective transferee-surface-dependent screen frequency has a nominal value of about 158 lines per inch when said respective single color is magenta; and said respective transferee-surface-dependent screen frequency has a nominal value of about 141 lines per inch when said respective single color is yellow.

13. The printer according to claim 11, wherein said transferee-surface-dependent screen frequency is about the same for each of said image-forming modules and is less than or equal to about 155 lines per inch.

14. The printer according to claim 11, wherein said toner particles have a diameter in a range of approximately between 7–9 micrometers.

15. The printer according to claim 11 wherein:

said toner particles are made of a polyester binder;

said sub-micron particles are made of silica;

said coverage of said sub-micron particles is greater than 0.5% (wt/wt) of said toner particles; and said sub-micron particles have a surface area in a range of about 110 $m^2$/gram–200 $m^2$/gram.

16. The printer according to claim 11 wherein:

said Young's modulus of said blanket layer is in a range of approximately 3.45 megapascals–4.25 megapascals;

said Shore A hardness of said blanket layer is in a range of approximately 55–65; and said respective transfer nip having a nip width in a range of approximately 2.5–4.5 mm.

17. The printer according to claim 11 wherein, in said secondary transfer, a pre-nip wrap is provided, said pre-nip wrap having a length in a range of approximately between 0 mm–6 mm.

18. The printer according to claim 17 wherein said pre-nip wrap has a length of approximately 3 mm.

19. The printer according to claim 11 wherein, in said secondary transfer, a post-nip wrap is provided, said pre-nip wrap having a length in a range of approximately between 0 mm–6 mm.

20. The printer according to claim 19 wherein said post-nip wrap has a length of approximately 0 mm.

21. The printer according to claim 11 wherein:

said dwell time in said fusing nip is in a range of approximately 0.054 seconds–0.067 seconds;

said nip width of said fusing nip is in a range of approximately 16.5 mm–19.5 mm;

said engagement in said fusing nip is in a range of approximately 0.9 mm–1.4 mm;

said operating temperature in said fusing nip is in a range of approximately 100° C.–200° C.; and said lineal pressure provided in said fusing nip is in a range of approximately 30 pounds per lineal inch–60 pounds per lineal inch.

22. A method of enabling full-color prints on receiver members having various types of transferee surfaces, which various types of transferee surfaces include smooth, rough, textured, patterned, and woven surfaces, said method utilizing a modular printer comprising a number of tandemly arranged image-forming modules, each of said modules for creating toner images of a predetermined color, each of said modules including a primary imaging member, an intermediate transfer member, a charging station, an image writing station, a development station, and an intermediate transfer station, each receiver member being moved successively through said modules to form an unfused color print thereon, and thereafter through a fusing station so as to form a fused color print thereon, said method comprising the following steps:

in a respective charging station, controllably charging a primary imaging member to an optimized transferee-surface-dependent potential;

in a respective image writing station, digitally exposing a photoconductive primary imaging member, said digitally exposing characterized by an optimized transferee-surface-dependent screen frequency, an optimized transferee-surface-dependent screen angle, an optimized transferee-surface-dependent maximum exposure per unit area, and an optimized transferee-surface-dependent exposure profiling for creating profiled dots;

in a respective development station, toning with surface treated polymeric toner particles, said toner particles characterized by an optimized coverage of adhered sub-micron particles;

in a respective intermediate transfer station, transferring a single-color toner image from said photoconductive primary imaging member to said intermediate transfer member, said intermediate transfer member including a blanket layer, said blanket layer having a optimized thickness, an optimized Young's Modulus, a optimized Shore A hardness, and an optimized electrical resistivity, said blanket layer overcoated by a hard layer having an optimized thickness and an optimized electrical resistivity;

in said respective intermediate transfer station, electrostatically transferring, without thermal assist, said single-color toner image from said intermediate transfer member to a receiver member, said receiver member moving through a transfer nip formed between said intermediate transfer member and a transfer backup roller, said transfer backup roller including a compliant layer having an optimized thickness, an optimized Young's Modulus, an optimized Shore A hardness and an optimized electrical resistivity, with an optimized lineal pressure provided along said respective transfer nip;

fusing said unfused color print to said receiver member in said fusing station, which fusing station includes a conformable, heated, fuser roller and a pressure roller forming therebetween a fusing nip through which said receiver member passes, said fusing characterized by an optimized dwell time, an optimized fusing nip width, an optimized engagement, an optimized temperature of said fuser roller, and an optimized lineal pressure provided along said fusing nip;

wherein said respective charging station, said respective image writing station, said respective development station, said respective intermediate transfer station and said fusing station have been co-optimized so as to produce, for said fused color print made on said various types of transferee surfaces, an image quality which is at least as good as a predetermined nominal image quality; and wherein a surface roughness parameter characterizes said various types of transferee surfaces, said surface roughness parameter being a Sheffield Number having a value in a range between zero Sheffield units and at least approximately 300 Sheffield units.

* * * * *